United States Patent [19]

Mesenich et al.

[11] Patent Number: 4,708,117

[45] Date of Patent: Nov. 24, 1987

[54] MULTI-POINT FUEL INJECTION APPARATUS

[75] Inventors: Gerhard Mesenich, Bochum, Fed. Rep. of Germany; Hansueli Bart; Daniel E. Alsbrook, both of Mt. Clemens, Mich.

[73] Assignee: Colt Industries Inc., New York, N.Y.

[21] Appl. No.: 851,567

[22] Filed: Apr. 14, 1986

[51] Int. Cl.[4] ..... F02M 23/00

[52] U.S. Cl. ..... 123/533; 123/531; 123/445

[58] Field of Search ..... 123/533, 531, 527, 520, 123/445; 261/23 A, 50 A

[56] References Cited

U.S. PATENT DOCUMENTS

| | | | |
|---|---|---|---|
| 1,232,207 | 7/1917 | Büchi | 123/533 |
| 1,800,581 | 5/1931 | Bethenod | 123/533 |
| 1,871,115 | 8/1932 | Cowardin et al. | 123/533 |
| 4,224,915 | 9/1980 | Emmenthal et al. | 123/533 |
| 4,387,695 | 6/1983 | Huppel et al. | 123/531 |
| 4,465,650 | 8/1984 | Igashira et al. | 123/531 |
| 4,519,356 | 5/1985 | Sarich | 123/533 |
| 4,543,939 | 10/1985 | Ehrhart et al. | 123/531 |
| 4,556,037 | 12/1985 | Wisdom | 123/531 |
| 4,561,405 | 12/1985 | Simons | 123/531 |
| 4,570,598 | 2/1986 | Samson | 123/445 |

*Primary Examiner*—Raymond A. Nelli
*Attorney, Agent, or Firm*—Walter Potoroka, Sr.

[57] ABSTRACT

A fuel injection fuel supply system for a combustion engine has a single fuel injector valve effective for injecting all of the required fuel in equal amounts to each of the combustion cylinders of the engine through chamber means exposed to superatmospheric air; the injected fuel and the superatmospheric air combine to form a fuel-air emulsion which flows to the intake of each of the combustion cylinders.

37 Claims, 24 Drawing Figures

MULTI-POINT FUEL INJECTION APPARATUS

FIELD OF THE INVENTION

This invention relates generally to fuel injection systems and more particularly to fuel injection systems and apparatus for metering fuel flow to an associated combustion engine.

BACKGROUND OF THE INVENTION

Even though the automotive industry has over the years, if for no other reason than seeking competitive advantages, continually exerted efforts to increase the fuel economy of automotive engines, the gains realized thereby have been deemed by governmental bodies as being insufficient and such governmental bodies continue to impose increasingly stringent regulations relative to engine fuel economy as well as the maximum permissible amounts of carbon monoxide, hydrocarbons and oxides of nitrogen which may be emitted by the engine exhaust gases into the atmosphere.

In an attempt to meet such stringent regulations, the prior art has heretofore proposed the employment of a carburetor structure provided with electromagnetic duty-cycle valving means whereby the carburetor structure still functioned as an aspirating device but where the rate of fuel flow being aspirated is controllably modified by the duty-cycle valving means in response to feedback signals indicative of engine operation and other attendant conditions. Such carbureting structures, in the main, have not been found to be capable of satisfying the said continually increasing stringent regulations.

The prior art has also proposed the use of fuel metering injection means wherein a plurality of nozzle assemblies, situated as at the intake valves of respective cylinders of a piston engine, would receive fuel, under superatmospheric pressure, from a common fuel metering source and inject such fuel directly into the respective cylinders of the engine with such injection being done in timed relationship to engine operation. Such fuel injection systems, besides being costly, have not proven to be generally successful in that the system is required to provide metered fuel flow over a very wide range of metered fuel flows. Generally, those prior art injection systems which are very accurate at one end of the required range of metered fuel flows, are relatively inaccurate at the opposite end of that same range of metered fuel flows. Also, those prior art injection systems which are made to be accurate in the mid-portion of the required range of metered fuel flows are usually relatively inaccurate at both ends of that same range. The use of feedback means for altering the metering characteristics of such prior art fuel injection systems has not solved the problem of inaccurate metering because the problem usually is intertwined within such factors as: effective aperture area of the injector nozzle; comparative movement required by the associated nozzle pintle or valving member; inertia of the nozzle valving member; and nozzle "cracking" pressure (that being the pressure at which the nozzle opens). As should be apparent, the smaller the rate of metered fuel flow desired, the greater becomes the influence of such factors thereon.

The prior art has also heretofore proposed the employment of a throttle body with one or more electromagnetic duty-cycle type of fuel metering valving assemblies operatively carried thereby and spraying metered fuel, on a continual basis, into the air stream flowing through the throttle body and into the engine induction or intake manifold. Even though such arrangements, generally, are effective for providing closely controlled metered rates of fuel flow, they are nevertheless limited in their ability to meet the said increasingly stringent regulations. This inability is at least in part due to the fact that in such systems the throttle body is employed in combination with an engine intake or induction manifold through which the air and sprayed-fuel mixture is supplied to the respective engine cylinders. Because of design limitations, engine characteristics, cost factors and lack of repeatability in producing substantially identical intake manifolds, certain of the engine cylinders become starved for fuel when other engine cylinders are provided with their required stoichiometric fuel-air ratios. Consequently, the richness (in terms of fuel) of the entire fuel delivery system has to be increased to a fuel-air ratio which will provide the required stoichiometric fuel-air ratio to the otherwise starved engine cylinder or cylinders to obtain proper operation thereof. However, in so doing, the other engine cylinder or cylinders receive a fuel-air supply which is, in fact, overly rich (in terms of fuel) thereby resulting in reduced engine fuel economy and the increased production of engine exhaust emissions.

The prior art has also heretofore proposed the employment of a throttle body, which serves only to control the rate of air flow to an associated engine intake manifold, in combination with a plurality of electromagnetic duty-cycle type of fuel metering valving assemblies wherein respective ones of said plurality of duty-cycle valving assemblies are positioned in close proximity to respective ones of a plurality of engine cylinders as to thereby meter and discharge fuel into the induction system at respective points which are at least closely situated to the intake valves of the associated engine cylinder. In such an arrangement, it is often accepted practice to provide a common manifold of fuel, regulated at superatmospheric pressure, which feeds or supplies unmetered fuel to the respective duty-cycle valving assemblies where the metering function is performed. These systems are very costly in that a plurality of duty-cycle valving and metering assemblies are required and such valving assemblies, to obtain optimum performance, must be flow-matched to each other as sets for the engine. Further, in such arrangements, it is accepted as best practice to replace all duty-cycle valving assemblies upon failure of one or more in order to thereby again result in a matched set of injectors for the engine. Also, in such systems, if one of the injectors or duty-cycle valving means starts to malfunction, and if exhaust constituent sensor and feedback signal generating means are employed, the associated electronic control means will attempt to further increase or decrease (as the case may be) the richness of the fuel-air ratio of the remaining injector assemblies since the exhaust feedback signal cannot distinguish whether the change sensed in the exhaust constituents is due to one or more injector assemblies malfunctioning or whether the overall system needs a modification in the rate of metered fuel flow.

The invention as herein disclosed and described is primarily directed to the solution of the aforestated and other related and attendant problems of the prior art.

SUMMARY OF THE INVENTION

According to the invention a fuel metering system for an associated combustion engine having a plurality of combustion cylinders each provided with intake valve means, comprises a plurality of fuel nozzle means, a fuel metering valving member movable to and from open and closed positions to accordingly permit and terminate the flow of fuel through said plurality of nozzle means, to thereby meter the rate of fuel flow through said nozzle means, electromagnetic motor means for causing said metering valving member to be moved to said open and closed positions, chamber means, conduit means for supplying air at a superatmospheric pressure to said first chamber means, and a plurality of fuel-air transport conduit means communicating with said chamber means, said plurality of fuel-air transport conduit means being effective to receive the fuel as is metered through said nozzle means and to receive the superatmospheric air received in said chamber means and deliver a flow of fluid comprised of said metered fuel and said superatmospheric air as a fuel-air emulsion to spaced receiving areas of the combustion engine.

Various general and specific objects, advantages and aspects of the invention will become apparent when reference is made to the following detailed description considered in conjunction with the accompanying drawings.

BRIEF DESCRIPTION OF THE DRAWINGS

In the drawings, wherein for purposes of clarity certain elements and/or details may be omitted from one or more views.

DETAILED DESCRIPTION OF THE PREFERRED EMBODIMENT OF THE INVENTION

Figure 1:
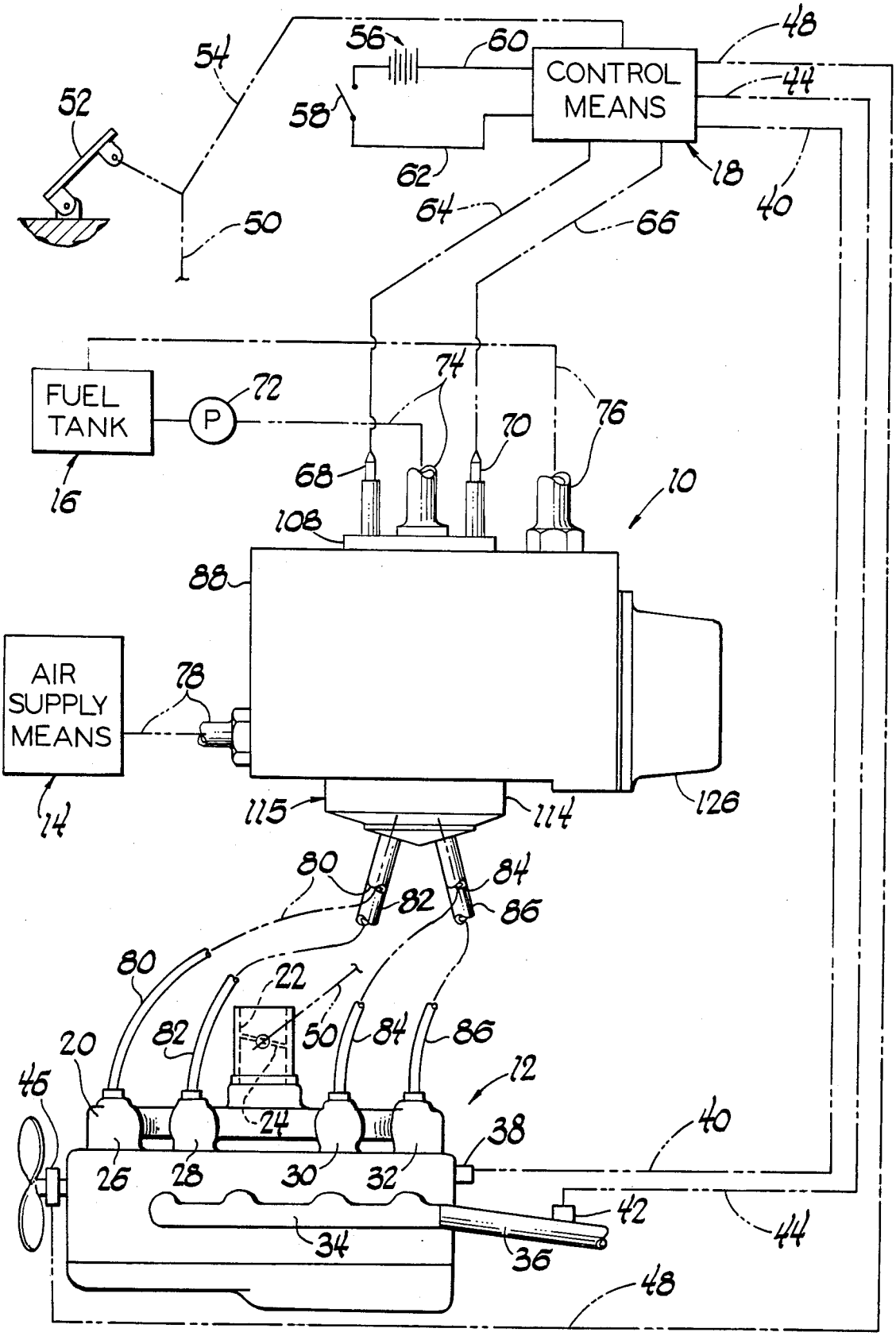
FIG. 1 is a view of a fuel metering assembly, employing teachings of the invention, along with both diagrammatically and schematically illustrated elements and components depicting, in simplified manner, an overall fuel supply and metering system for an associated combustion engine.

Referring now in greater detail to the drawings, FIG. 1 illustrates a fuel metering and delivery apparatus or system 10, a combustion engine 12, an air supply means 14, a fuel reservoir or fuel tank 16 and an associated control means 18.

The engine 12 may be provided with a manifold-like induction passage means 20 which communicates with the ambient atmosphere as by induction passage means 22 having a pivotally mounted and manually positionable throttle valve means 24 therein. An air intake cleaner, not shown but well known in the art, may be operatively connected to the intake end of induction passage means 22. In the embodiment illustrated, the engine 12 is depicted as a four cylinder engine and the induction manifold or passage means 20, as at portions 26, 28, 30 and 32, serves to communicate with the respective intake port means of the respective engine cylinders. As is well known in the art, such intake port means may be controlled by what are commonly referred to as engine intake valves which are opened and closed in timed relationship to engine operation. An engine exhaust manifold 34 communicates with the respective exhaust port means of the respective engine cylinders and with an engine exhaust pipe or conduit 36 which discharges the engine exhaust to ambient.

The control means 18 may comprise, for example, suitable electronic logic type control and power output means effective to receive one or more parameter type input signals and in response thereto produce related outputs. For example, engine temperature responsive transducer means 38 may provide a signal via transmission means 40 to control means 18 indicative of the engine temperature; sensor means 42 may sense the relative oxygen content of the engine exhaust gases (as within engine exhaust conduit means 36) and provide a signal indicative thereof via transmission means 44 to control means 18; engine speed responsive transducer means 46 may provide a signal indicative of engine speed via transmission means 48 to control means 18 while engine load, as indicated for example by the position of the engine induction system throttle valve means 24, may provide a signal as via transmission means 50 operatively connected to an engine operator's foot-actuated throttle pedal lever 52 and operatively connected as by the same transmission means or associated transmission means 54 to control means 18. A source of electrical potential 56 along with related switch means 58 may be electrically connected as by conductor means 60 and 62 to control means 18. The output terminals of control means 18 are respectively electrically connected as via conductor means 64 and 66 to electrical terminals 68 and 70, of the metering means 10, which in turn are electrically connected to opposite electrical ends of an associated electrical field generating coil means.

The fuel tank or reservoir means 16 supplies fuel to associated fuel pump means 72 (which may be situated internally of the reservoir means 16) which, in turn, supplies fuel at a superatmospheric pressure via conduit means 74 to the inlet of the metering apparatus or means 10. Outlet or return conduit means 76 serves to return excess fuel to an area upstream of the pump 72 as, for example, the fuel reservoir means 16.

The air supply means 14 serves to supply air, via conduit means 78, at a superatmospheric pressure to the metering and supply means 10.

Fuel-air emulsion transporter conduit means 80, 82, 84 and 86 serve to deliver a fuel-air emulsion from the metering means to discharge or receiving areas at least in close proximity to the respective engine cylinder intake port means situated generally in the vicinity of the induction portions 26, 28, 30 and 32.

Referring in greater detail to FIGS. 2–10, the metering assembly 10 is illustrated as comprising a main body or housing means 88 with a generally cylindrical counterbore 90 formed therein which slidably receives a generally annular end member 92, comprised as of steel, which, in turn, is provided with a first peripheral recess which partly receives and locates an O-ring 94 which prevents fluid (in this case fuel) flow therepast.

A generally tubular shell 96 is closely received within the counterbore 90 and axially abuts against the upper (as viewed in FIG. 2) surface 98 of annular end member 92. The said upper surface 98 has an annular groove formed therein which partly receives and locates an O-ring 100 which serves to seal and prevent the flow of fuel therepast when the juxtaposed axial end 102 of an associated bobbin 104 is seated against surface 98.

The bobbin 104 carries a field coil means 106 which, as previously indicated, is electrically connected to the terminals 68 and 70 (FIG. 1). The entire subassembly comprising the end member 92, shell 96, bobbin 104, coil 106, terminals 68 and 70, and pole piece (not shown but many well known in the art) are secured, and sealed, within the counterbore or chamber 90 as by a suitable clamp 108 and associated suitable fastener means one of which is depicted at 110.

A guide stem and nozzle member 112 is suitably retained as within a cooperating recess, formed in body means 88, and against a cooperating housing portion 114 of what may be considered a distributor assembly 115. An O-ring seal 116, generally between the housing body means 88 and the flange-like end of member 112 serves to prevent fuel flow therepast.

A generally tubular member 118 is piloted on and movable relative to the stem portion of member 112. Generally, upon energization of the coil means 106, member 118 is caused to move upwardly (as viewed in FIG. 2) against the resistance of spring means 119 thereby having its lower flange-like end open the previously closed fluid flow passages or nozzles formed in the guide stem and nozzle member 112.

A fuel pressure regulator assembly 120 is depicted as comprising a first chamber 122 formed in body means 88 and a second chamber 124 formed within a cover-like housing section 126 with a pressure responsive movable diaphragm or wall means 128, suitably peripherally retained, effectively separating and forming a common wall between chambers 122 and 124. A valve carrier 130 has an annular portion 132 thereof held against the chamber 122 side of diaphragm 128 while another portion 134 thereof extends through the diaphragm 128 and through a backing plate 136 to which portion 134 is suitably secured. A spring 138 has one end operatively engaged with backing plate 136 and has its opposite end operatively engaged with a spring perch member 140 which, in turn, is carried by an adjustment screw 142. Once the proper pressure regulation is attained, as by adjustment of screw 142, the outer opening is preferably sealingly closed as by suitable sealing means 144.

The valve carrier 130 is provided with a cavity which in turn receives a ball valve member 146 which is modified to have a flatted valving surface 148. The ball valve 146 may be retained generally within the carrier cavity as by having a portion 150 of the carrier formed against ball valve 146. Further, the carrier 130 may be provided with a counterbore portion into which a compression spring 152 is fitted as to continually bear against ball valve 146 and thereby, through frictional forces, greatly minimize if not entirely eliminate any tendency of the ball valve 146 moving from its desired orientation for best seating action against the cooperating seating surface 154 of a valve seat member 156 which may have its body pressed into a passageway or conduit 158 formed in body means 88. Additional conduit means 160 serves to complete communication as between valve seat member 156, and conduit 158, and conduit means 76.

Generally, the fuel supplied via conduit means 74 flows through the annular space between the outer cylindrical surface 162 of member 118 and the inner cylindrical surface 164 of the tubular portion 166 of bobbin 104 as well as the inner cylindrical surface 168 of the flex-path end member 92. Such fuel as flows through such annular space eventually flows into a chamber-like portion 170 from where, as will be described in detail, it is metered to the engine. A conduit 172 communicates with chamber 170 and serves to provide for fuel flow from chamber 170 to chamber 122 where the pressure of such fuel is applied to the diaphragm or movable wall means 128. Generally, whenever the pressure of the fuel exceeds a predetermined magnitude diaphragm means 128 is moved further to the right, against the resistance of spring means 138, thereby moving the ball valve 146 in a direction away from its cooperating seating surface 154 allowing a portion of the fuel to be bypassed via valve seat 156, conduit 158, conduit 160 and return conduit means 76. Such opening and closing movements of pressure regulator valve member 146 serves to maintain a substantially constant fuel metering pressure differential.

A conduit 174, which may be formed in body means 88, receives the superatmospheric air from conduit means 78 and directs such air as to a receiving area of the distributor assembly 115.

Referring also to FIGS. 3–8, the distributor body means 114 is depicted as comprising an upper (as viewed in any of FIGS. 2, 5, 7 and 8) mounting surface means 176 which may be employed for mounting against a cooperating surface 178 of body means 88. The body means 114 may have a generally rectangular outer configuration, forming side walls 180, 182, 184 and 186 (having their respective intersecting corners rounded).

The lower surface 188 of the distributor body means 114 may be of conical configuration with the angle of inclination thereof being, for example, in the order of 9.0° when measured from a horizontal plane or one parallel to surface means 176.

As shown in FIGS. 2, 3, 7 and 8, a circular recess or groove 190 is formed into body means 114 from upper surface 176 thereof so that upon securing body means 114 to housing means 88 such recess or groove 190 effectively becomes a chamber or manifold. A second groove 192 radially outwardly of groove 190 serves to retain an O-ring seal 194 which, when body 114 is secured to housing 88, creates a fluid seal therebetween.

In the embodiment disclosed, keying means are provided in order to maintain a preselected physical relationship among several of the elements and/or details. Such will be later described in greater detail; however, at this point it is sufficient merely to state that cooperating blind (closed end) holes are formed in the housing means 88 and in body 114 with cooperating keying or locating pins received by such. The blind holes formed in body 114 are depicted at 196 and 198 such being formed diametrically opposite to each other and normal to surface means 176.

In the embodiment shown four generally cylindrical passage means 200, 202, 204 and 206 are formed through body means 114 in a manner whereby, preferably, the respective axes thereof meet at a common point which also lies in a vertically extending axis 208. Further, in the embodiment disclosed, the said respective axes, of passage means 200, 202, 204 and 206 form an angle of substantially 9.0° with axis 208.

Figure 7:
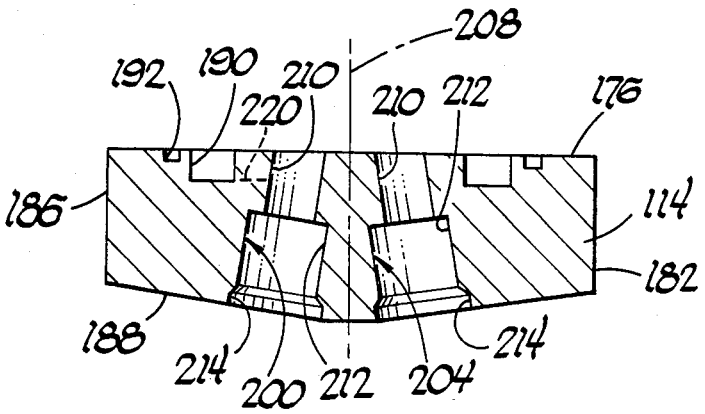
FIG. 7 is a cross-sectional view taken generally on the plane of line 7—7 of FIG. 3 and looking in the direction of the arrows.
Figure 8:
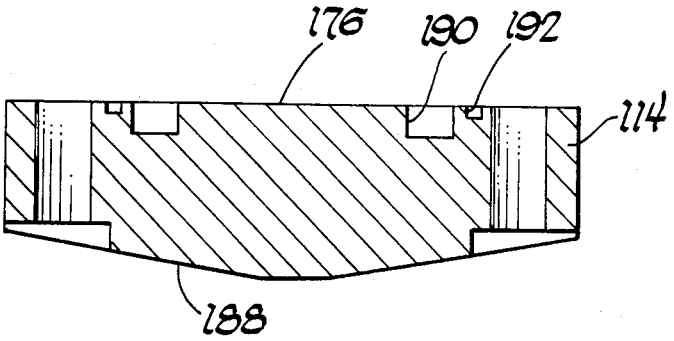
FIG. 8 is a cross-sectional view taken generally on the plane of line 8—8 of FIG. 6 and looking in the direction of the arrows.

As best and typically illustrated in FIG. 7 by each of passage means 200 and 204, each passage means 200, 202, 204 and 206 is preferably comprised of a first cylindrical passage portion 210 communicating with a serially situated relatively enlarged second cylindrical passage portion 212 and a further serially situated still further enlarged cylindrical counterbore 214.

Figure 3:
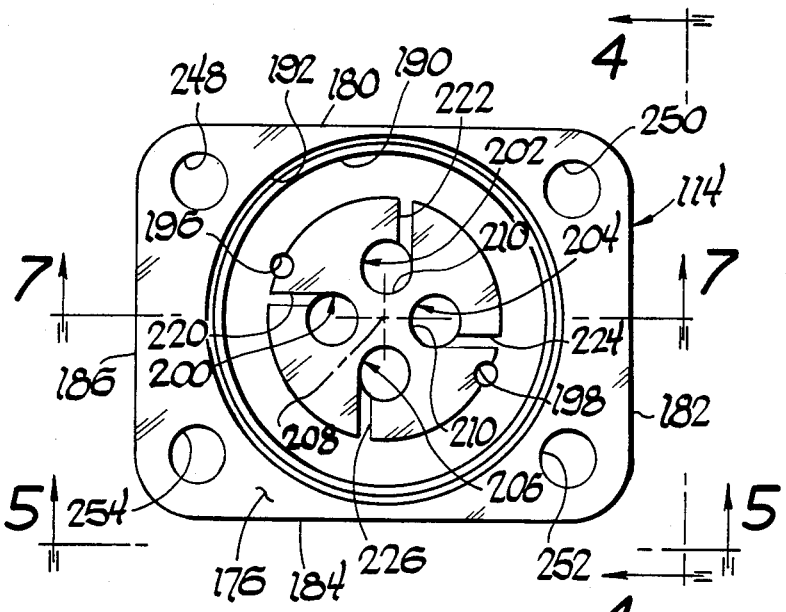
FIG. 3 is a plan view of one of the elements shown in FIG. 2.
Figure 4:
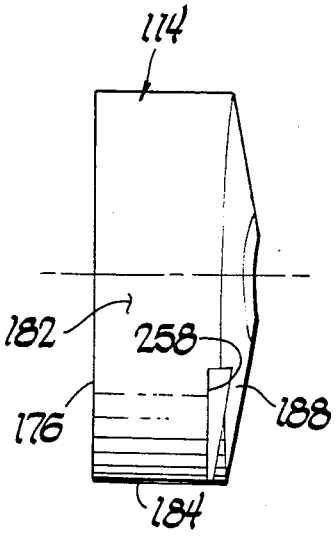
FIG. 4 is a view taken generally on the plane of line 4—4 of FIG. 3 and looking in the direction of the arrows.
Figure 5:
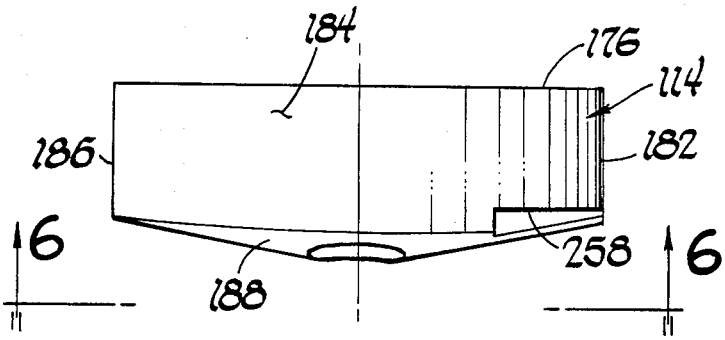
FIG. 5 is a view taken generally on the plane of line 5—5 of FIG. 3 and looking in the direction of the arrows.
Figure 6:
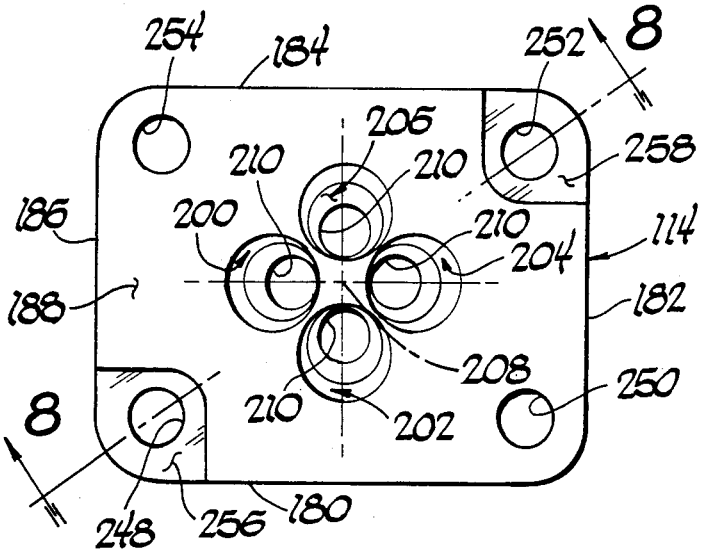
FIG. 6 is a view taken generally on the plane of line 6—6 of FIG. 5 and looking in the direction of the arrows.

As best seen in FIGS. 3 and 7, a plurality of slots or recesses 220, 222, 224 and 226 are also formed into body 114 through surface 176 as to respectively complete communication between air distribution chamber 190 and passage means 200, 202, 204 and 206 when the body 114 is assembled to housing means 88. More particularly, such slots (functionally forming passages) 220, 222, 224 and 226 communicate with passage means 200, 202, 204 and 206 at and in the respective conduit portions 210 thereof.

Figure 2:
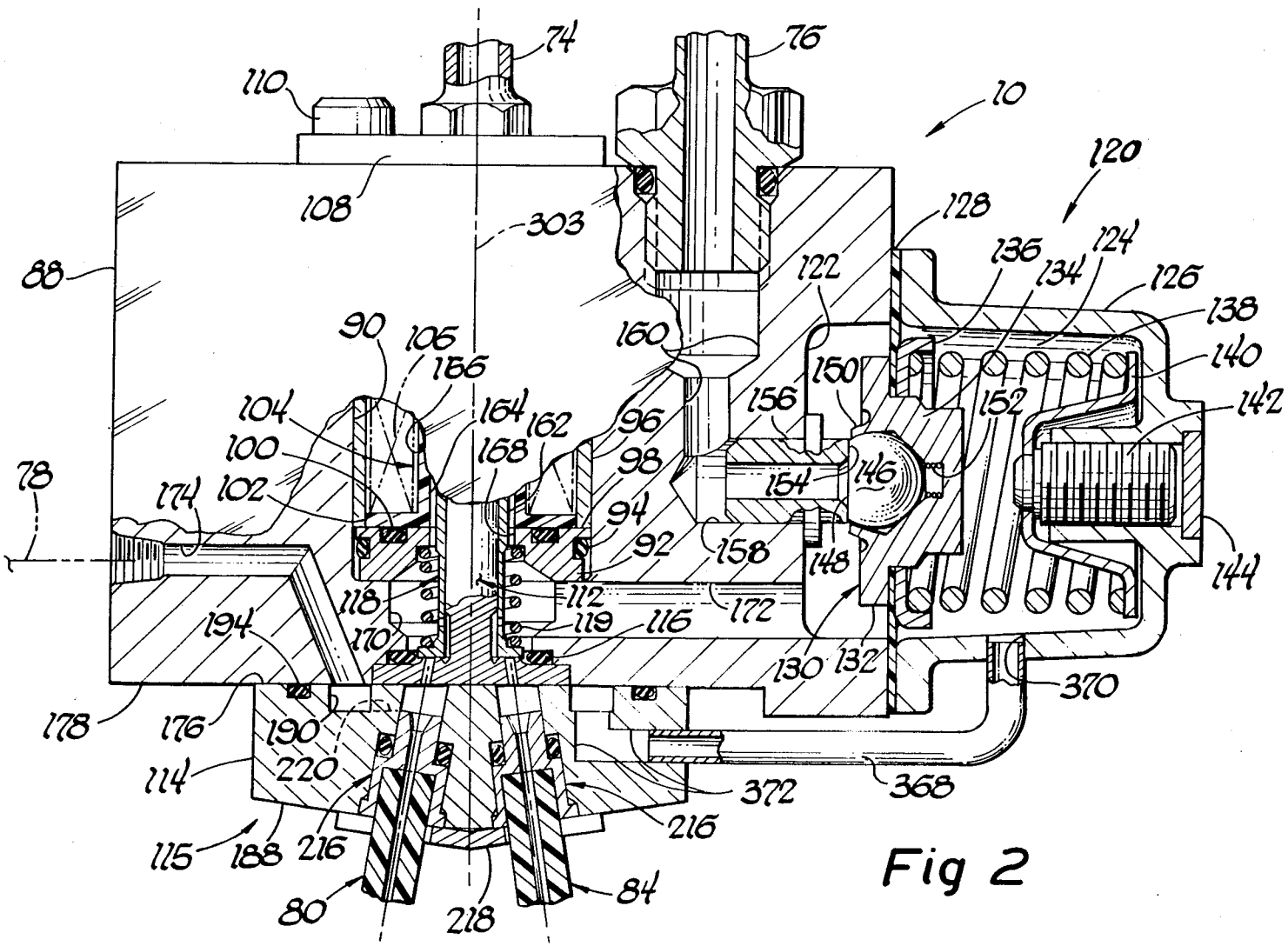
FIG. 2 is a relatively enlarged view of the fuel metering assembly of FIG. 1 with portions thereof broken away and in cross-section.
Figure 10:
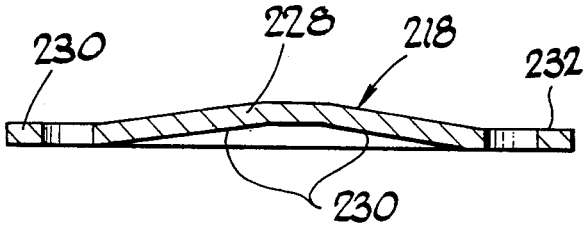
FIG. 10 is a cross-sectional view taken generally on the plane of line 10—10 of FIG. 9 and looking in the direction of the arrows.
Figure 9:
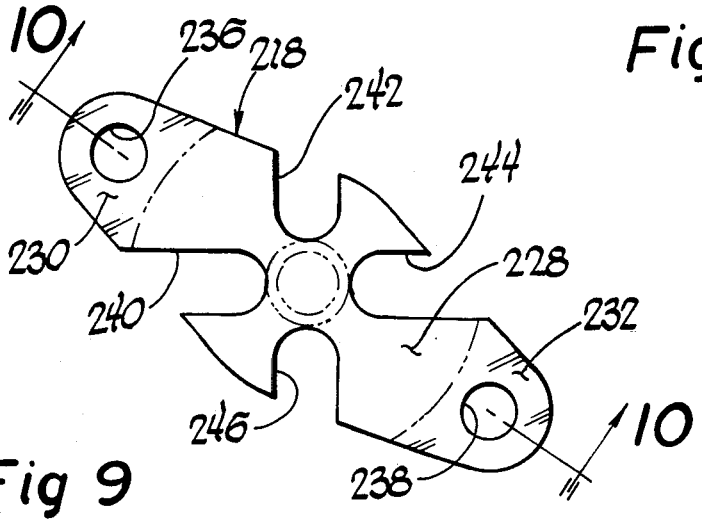
FIG. 9 is a view of another element shown in FIG. 2.

In the embodiment illustrated, the fuel-air transport conduit means 80, 82, 84 and 86 are each provided with an end fitting 216 which is sealingly received within the respective passage means 200, 202, 204 and 206. When thusly received, all of the end fittings 216 may be retained assembled to body 114 as by a retainer or clamping member 218 (FIGS. 2, 9 and 10). The clamping member 218 is depicted as comprising a generally medially situated body portion 228 which is bent into a generally conical contour having an inner seating surface 230 of a conically included angle in the order of 72.0°. At opposite ends of the medial body portion 228 are generally laterally extending integrally formed tab-like portions 232 and 234 through which are formed bolt or screw clearance holes 236 and 238. The medial body portion 228 has a plurality of slots 240, 242, 244 and 246 formed therein with such being arranged at an angle with respect to a line connecting the axes of holes 236 and 238 while opposed pairs of such slots are generally normal to each other as viewed in FIG. 9.

Referring also to FIGS. 3–8, a plurality of bolt or screw holes 248, 250, 252 and 254 are formed through body 114. At the lower end of body 114, two flatted surfaces 256 and 258 are respectively formed about holes 248 and 250. In assembling body means 114 to housing 88, the shanks of bolts or screws are first past through holes 248 and 252 and secured. The fuel-air transporter conduits 80, 82, 84 and 86 along with their respective fittings 216 may be suitably inserted and then clamp or retainer 218 is applied by accepting the transporter conduits while axially abutting against the outer ends of the respective fittings 216. The shanks of bolts or screws are respectively passed through holes 236 and 238 of retainer 218 and through holes 254 and 250 of body 114 and tightened as in threaded portions formed in said housing means 88. When assembled, as generally depicted in FIG. 2, air conduit means 174 is placed in communication with air distribution chamber means 190.

Figure 12:
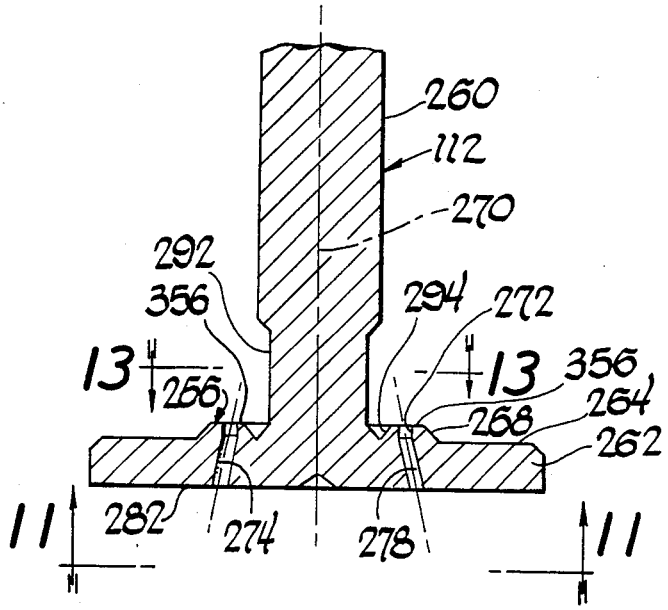
FIG. 12 is an axial cross-sectional view, of relatively enlarged scale, of a fragmentary portion of another element shown in FIG. 2.
Figure 13:
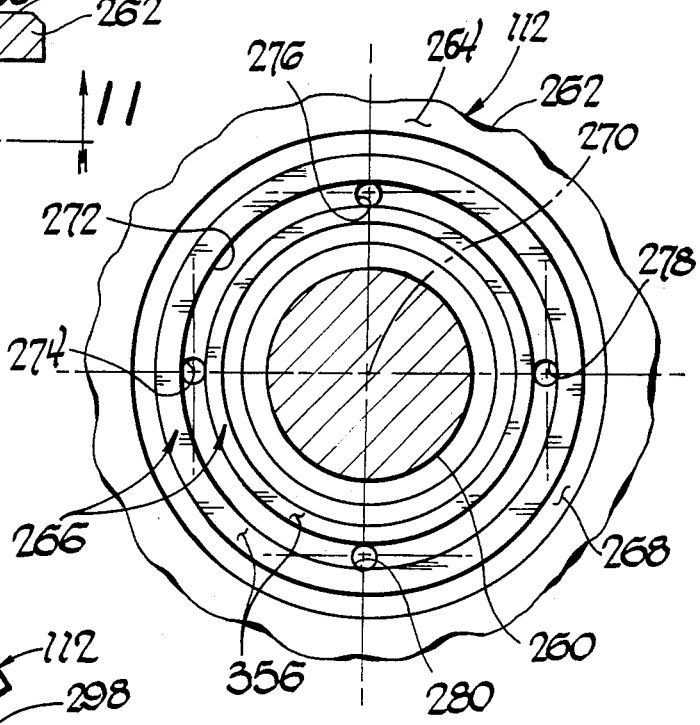
FIG. 13 is a further enlarged view taken generally on the plane of line 13—13 of FIG. 12 and looking in the direction of the arrows.
Figure 11:
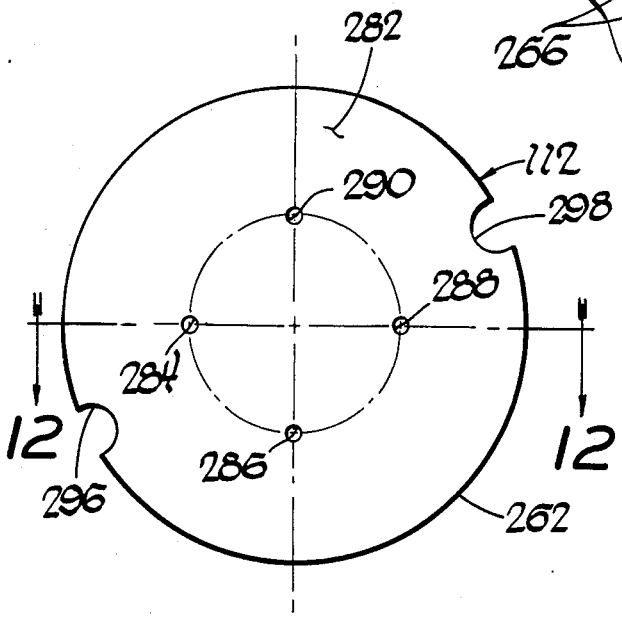
FIG. 11 is a view taken generally on the plane of line 11—11 of FIG. 12 and looking in the direction of the arrows.

Referring in greater detail to FIGS. 11–13, the guide stem and nozzle member 112 which, for example, may be formed of stainless steel, is illustrated as comprising a generally cylindrical guide stem portion 260 integrally formed with a disk-like nozzle head portion 262. The nozzle body portion 262 has, generally, two body thicknesses; that is a generally radially outer portion 264 is of relatively reduced thickness while the radially inner portion 266 is of relatively increased thickness. In the preferred embodiment, nozzle body portions 264 and 266 are blended to each other as by an inclined or conical-like surface 268 which is inclined toward the central axis 270 in the order of 45°.

A circular groove or recess 272 is formed into portion 266 as to have its axis generally colinear with axis 270 and as to have its upper end (as viewed in FIG. 12) open. A plurality of fuel nozzles or passages 274, 276, 278 and 280 are formed in head portion 262 so as to have the respective upper ends (as viewed in FIG. 12) thereof in communication with the fuel distribution ring 272 and as to have the respective lower ends 284, 286, 288 and 290 thereof opening at the lower end surface 282 of head portion 262.

In the embodiment disclosed, there are four of such fuel nozzles 274, 276, 278 and 280 which, as viewed in FIG. 13, are angularly spaced at 90° about the fuel manifold or distribution means 272 and, as viewed in FIG. 12, are each inclined as to have the respective axes thereof inclined 9.0° with respect to the central axis 270.

As seen in both FIGS. 2 and 12, the guide stem portion 260 has a cylindrical portion 292 of reduced diameter as at its lower end. A V-like circular groove 294 is formed in the head portion 266 as to be generally adjacent cylindrical portion 292 and spaced radially inwardly of fuel manifold means 272.

As best seen in FIG. 11, diametrically opposite situated keying slots or recesses 296 and 298 are formed in nozzle head 262 for coopertion with the keying pins previously referred-to.

Figure 14:
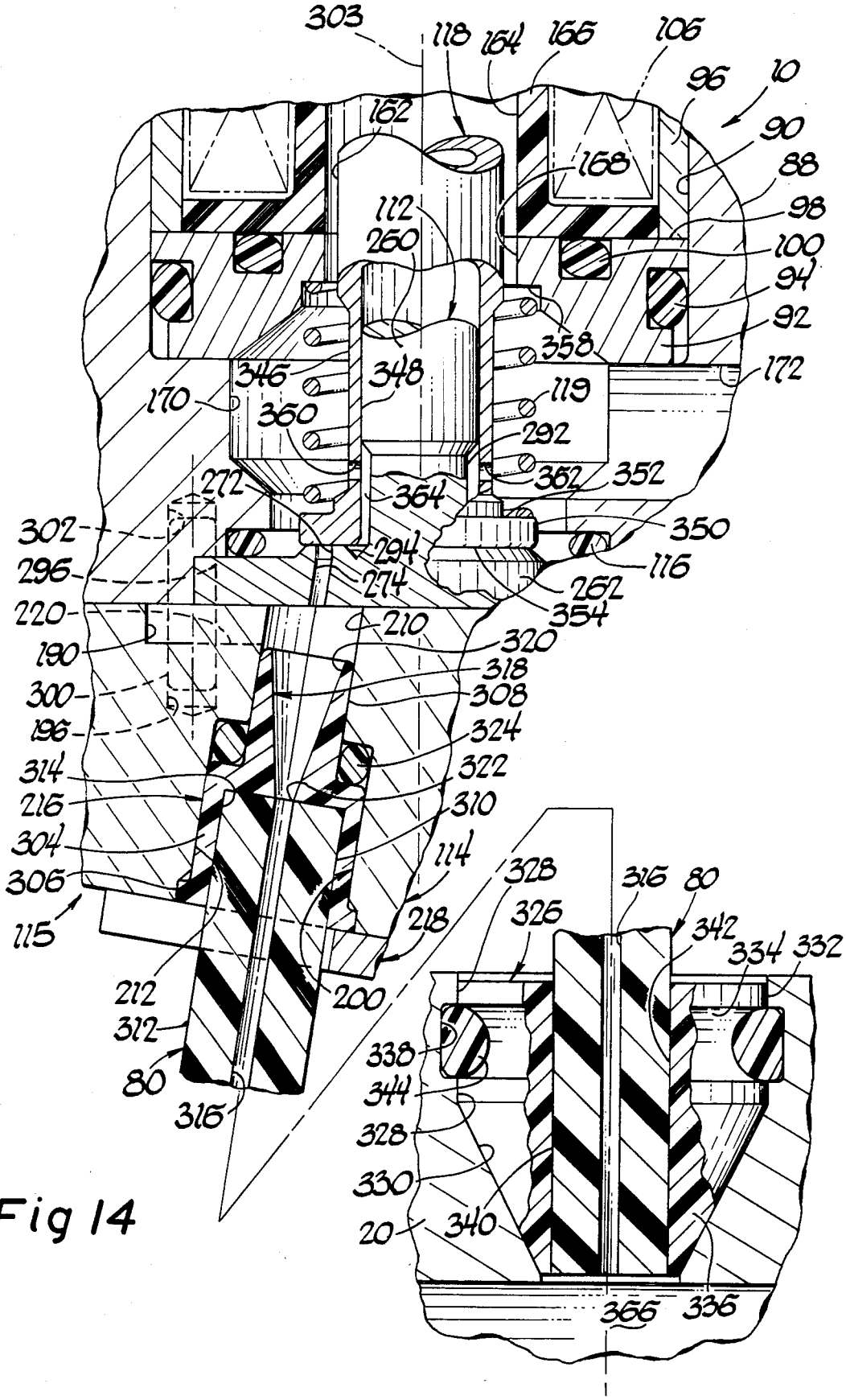
FIG. 14 is an enlarged view of a fragmentary portion of the structure of FIG. 2 as well as a fragmentary portion of the structure of FIG. 1.

Referring in greater detail to FIG. 14 wherein only one of the plurality of fuel-air transporter tubes or conduit means is shown and considered, one of two keying pins 300 (shown out of position for purposes of clarity) is depicted in hidden line as being pressed into the blind hole 196 of distributor body portion 114, engaging the keying recess 296 of nozzle head 262 and also pressed into an aligned blind hole 302 formed in housing means 88. A like or similar keying arrangement, not shown, is comprised of keying recess 298 of nozzle head 262, blind hole 198 of distributor body means 114, a keying or locating pin as that shown at 300 and, of course, a cooperating second blind hole, formed in housing means 88, as blind hole 302. When the elements are assembled as depicted in FIGS. 14 and 2, the axes 208 and 270 may be considered as forming a single axis 303.

As typically depicted in FIG. 14, the end fittings 216, preferably formed of a plastic material such as, for example, nylon, is preferably comprised of a generally cup-shaped main body portion 304 having a radiating flange portion 306 at its fully open end and a generally cylindrical axially extending body portion 308, of relatively reduced diameter. One end portion 310 of a tubular conduit member 312 is suitably received and contained, as well as retained, with the interior 314 of the cup-shaped main body portion 304. A flow passage 316 through conduit member 312 is thusly placed in alignment with a generally conical passage 318 formed within body portion 308 as to have its outer open end 320 directed toward the associated fuel nozzle (in this case nozzle 274) and tapering as to have its inner most end 322 of a reduced cross-sectional flow area generally equal to the cross-sectional flow area of flow passage 316. In the preferred embodiment, the tubular conduit member 312 is formed of plastic material such as, for example, "Teflon". "Teflon" is a trademark, of the DuPont de Nemours, E. I. & Co. of Wilmington, Del., U.S.A., for materials of tetrafluoroethylene fluorocarbon polymers. Further, in the preferred embodiment, during manufacture the end fitting 216 is molded directly onto the end of tubular conduit member 312 thereby simultaneously joining such and sealing against any flow therebetween. When the fitting 216 and associated tubular member are assembled to the distributor body means 114, the end fitting 116 is closely received with passage or conduit sections 210 and 212 while the flange 306 is forced generally inwardly, by clamp or retaining means 218, into the counterbore 214 (see FIG. 7). A suitable O-ring seal 324 is generally contained and compressed as between juxtaposed shoulders of fitting 216 and the passage means (in this case passage means 200).

As also typically illustrated in FIG. 14 each of the fuel-air transporter tubes or conduits, in this case 80, preferably comprises a discharge end fitting 326 which is suitably secured to the engine induction system as in, for example, the engine intake manifold means 20.

In the embodiment disclosed, the intake manifold 20 (which, of course, is simplistically illustrated, may be comprised of any desired configuration having respective runners extending to the fuel discharge and receiving areas 26, 28, 30 and 32) is formed with a cylindrical bore 328 and an inwardly extending and inwardly tapering conical-like passage 330 extending therefrom and opening into the interior of the induction passage wherein the discharge of fuel is desired as in close proximity to the engine intake port or valve means.

As depicted, the discharge end fitting 326, typically, may comprise a first upper disposed generally cylindrical body portion 332, provided with a circumferentially extending groove 334, and an integrally formed downwardly depending inwardly tapering generally conical body portion 336. An annular radially outwardly extending groove or recess 338 is formed in the wall of cylindrical bore 328 as to be in general juxtaposition to groove 334 when end fitting 326 is seated as illustrated.

In the preferred embodiment, the discharge end fitting is formed of a plastic material, such as, for example, "Teflon" and, further, is molded directly onto a discharge end portion 340 as of tubular member 312 thereby both retaining such end portion 340 and effectively sealing against flow as between end portion 340 and the juxtaposed inner portion 342 of fitting 326. An O-ring 344 carried as by groove or recess 338 serves to effectively lock and hold the end fitting 326 in assembled relationship with the induction structure 20 as by becoming received in both recesses 338 and 334 when the fitting 326 is seated. Such O-ring 344 also serves to seal against any flow therepast.

Still with reference to primarily FIG. 14, the valving member 118 is illustrated as having a tubular axially extending body 346 of which the inner cylindrical surface 348 is slidably piloted on and movable with respect to the guide stem portion 260 of member 112. At its lower end (as viewed in FIG. 14) the valving member 118 has an integrally formed radially outwardly extending flange 350 having an upper surface 352, against which one end of spring 119 is operatively engaged, and a lower surface 354 which serves as a valving surface when brought against the surfaces 356 (see FIG. 13) effectively surrounding the fuel distribution passage or groove 272. The opposite end of spring 119 may be seated as against a seating surface 358 formed in the end flux member 92. A plurality of holes or passages, two of which are illustrated at 360 and 362, are formed through the wall of tubular valving member 118 generally near the lower end thereof and serve to complete free communication as between chamber means 170 (radially outwardly of valving member 118) and the annular space 364 existing between the inner cylindrical surface 348 of valving member 118 and cylindrical portion 292 of stem and nozzle member 112. As is clearly shown in FIG. 14, in the preferred arrangement such annular space 364 is in communication with the circular groove or recess 294.

In the preferred embodiment, valving member 118 is also the armature so that upon energization of the coil means 106 the valving member 118 is caused to move upwardly (as viewed in FIGS. 2 and 14) against the resilient resistance of spring 119 thereby opening the fuel distribution ring 272 to the pressure regulated superatmospheric fuel in chamber means 170 and causing fuel to be metered through nozzle means 274, 276, 278 and 280 with such being respectively discharged at ports 284, 286, 288 and 290 (also see FIG. 11).

Operation of Invention

The rate of metered fuel flow, in the embodiment disclosed, will be principally dependent upon the relative percentage of time, during an arbitrary cycle time or elapsed time, that the valve member 118 is relatively close to or seated against seating surface means 356 of the nozzle body portion 262 as compared to the percentage of time that the valve member 118 is opened or away from the cooperating seating surface means 356.

This is dependent upon the output to coil means 106 from the control means 18 which, in turn, is dependent upon the various parameter signals received by the control means 18. For example, if the oxygen sensor and transducer means 42 senses the need of a further fuel enrichment in the motive fluid being supplied to the engine and transmits a signal reflective thereof to the control means 18, the control means 18, in turn, will require that the metering valve 118 be opened a greater percentage of time as to provide the necessary increased rate of metered fuel flow. Accordingly, it will be understood that given any selected parameters and/or indicia of engine operation and/or ambient conditions, the control means 18 will respond to the signals generated thereby and respond as by providing appropriate energization and de-energization of coil means 106 (causing corresponding movement of valve member 118) thereby achieving the then required metered rate of fuel flow to the engine 12.

More particularly, assuming that the coil means 106 is in its de-energized state, spring 119 will urge valve member 118 downwardly, along the guide stem portion 260, causing the lower axial end face or valving surface 354 thereof to sealingly seat against the cooperating seating surface means 356 of nozzle body 262 thereby preventing fuel flow from chamber 170 into fuel distribution ring 272.

When coil means 106 becomes energized a magnetic flux is generated and such flux includes armature valving member 118 which reacts by being drawn upwardly along guide stem portion 260, against the resistance of spring 119, until such armature valving member 118 operatively abuts against related stop means which determines the total stroke or travel of the armature valving member 118. Such total stroke or travel of armature valving member 118, from its seated or closed position to its fully opened position against said related stop means, may be, for example, in the order of 0.05 mm. It should be clear that during the entire opening stroke as well as during the entire closing stroke, the valving member 118 is guided on stem portion 260.

During engine operation, which may include engine cranking, pressurized air is supplied to conduit means 174 by the source 14. The air thusly supplied is directed to the air distribution chamber means 190 generally circumscribing the passage means 200, 202, 204 and 206. The interconnecting passages 220, 222, 224 and 226 serve to convey the pressurized air from distribution chamber 190 to the respective passage means 200, 202, 204 and 206 where it flows into the generally conical opening 318 of each of the end fittings 216. At the same time the valving member 118 is rapidly being cyclically opened and closed and during the time that it is opened, the pressurized fuel within chamber 170 is metered as solid fuel through each of the nozzles 274, 276, 278 and 280. The fuel as is metered through said nozzles 274, 276, 278 and 280 emerges from outlet or discharge orifices 284, 286, 288 and 290 in a path and direction ideally colinear with the respective axes of nozzles 274, 276, 278 and 280 which, in turn, are ideally respectively colinear with the axes of the end fitting chambers 318 in the passage means 200, 202, 204 and 206.

As can be seen, especially with reference to FIG. 14, the thusly supplied pressurized air and the metered fuel discharged from the metering nozzle or passage (typically illustrated by 274) both flow in the same direction toward and into conical chamber 318 which effectively functions as a collecting and/or mixing chamber means. That is, the metered fuel and air flowing into chamber means 318 are effectively collected by such chamber means 318 and experience some degree of intermixing as the resulting stream of commingled fuel and air flows axially along and within chamber means 318 toward flow passage 316. This flow of commingled fuel and air may be considered as an emulsion of fuel and air with the air serving as the principal medium for transporting the fuel along and through the transporter passage 316 and to the point of ultimate discharge to the engine as at receiving area 366.

In the preferred embodiment, the operating pressure of the air supplied to the air distribution means may be, for example, in the range of 15.0 to 40.0 p.s.i.g. (at standard conditions) while the magnitude of the regulated pressure of the fuel in chamber means 170 may be in the order of an additional 1.0 atmosphere differential with respect to the then existing pressure of the air supplied by means 14. The cross-sectional diameter of (each) transporter passage 316 may be in the order of 0.80 to 1.50 mm. In one successful embodiment of the invention tested, the cross-sectional diameter of the transporter passage 316 was in the order of 0.85 mm. and the cross-sectional diameter of each of the fuel nozzles (one shown at 274) was in the order of 0.50 mm.

Because of the relatively high magnitude of air pressure supplied by means 14, there is always a high speed flow through the respective transporter passages 316 resulting not only in the fuel-air emulsion being transported therethrough but also causing the fuel-air emulsion to undergo at least two flow phases resulting in a continuing mixing action of such fuel-air emulsion as it flows to be discharged into the receiving area 366. As a consequence of such high speed flow, flow-phase changes and continued mixing of the fuel-air emulsion the mean fuel droplet size, at the point of discharge of the fuel-air emulsion to the engine, may be as low as 10–30 microns with the result that such small fuel droplet size greatly reduces the emissions of the engine under lean (in terms of fuel) operating conditions.

Further, in the preferred embodiment, the volume rate of flow of air supplied by air supply means 14 to the transporter tubes or conduit means 80, 82, 84 and 86 is one-half to one-third less than that required to sustain idle engine operation. The air provided by means 14 is only for the purpose of transportation, emulsification and break-down of fuel droplet size as is delivered to the designated receiving area of the engine. The balance of the air required to not only sustain engine idle operation but for all conditions of engine operation is provided by the variably openable and closable throttle valve means, simplistically illustrated at 24 of FIG. 1, which controls the air flow as to the engine induction means 20.

Still with reference primarily to FIG. 14, it can be seen that in the embodiment illustrated the pressurized fuel not only fills annular chamber 364 but also fills the circular recess or groove 294 which is in direct communication with chamber 364 even when armature valve member 118 is in its seated closed condition or position against cooperating seating surface means 356 (FIG. 13). This enables fuel to flow from two radial directions toward the fuel distribution ring or channel 272 whenever metering valve member 118 is moved to an open position. More particularly, when armature metering valve member 118 is moved upwardly (as viewed in FIGS. 2 and 14) to an open position, the pressurized fuel in channel 294 quickly flows radially outwardly, between juxtaposed surface 354 of metering valve 118 and surface means 356 of nozzle head 262, toward the circular channel or groove 272; simultaneously, the fuel in chamber 170, generally radially outwardly of, for example, surface 268 (FIG. 12), quickly flows radially inwardly between juxtaposed surfaces 354 and 356 toward the same circular channel or groove 272. In this way the entire fuel distribution channel 272 is assured of being filled and acted upon by the pressure of the fuel within chamber 170 every time that valve member 118 is moved toward an open position.

It should be apparent that FIG. 14 is intended, among other things, to disclose and illustrate a typical arrangement of a fuel transporter conduit means as singly depicted by 80. In the embodiment as depicted in FIG. 1 (of which FIG. 14 is an enlarged fragmentary portion in cross-section) four transporter conduit means 80, 82, 84 and 86 are depicted with such transporter conduit means respectively communicating with spaced fuel-receiving areas of the engine 12. The remaining transporter conduit means 82, 84 and 86 would be as transporter conduit means 80 and, further, respectively communicate with nozzle means 276, 278 and 280 as well as with the air distribution chamber means 190 via passages 222, 224 and 226, respectively. The fuel-air emulsion created, the fuel-air emulsion flow phases referred to, the continuing mixing of the fuel-air emulsion and the size of the fuel droplets discharged to the engine as described with reference to transporter conduit means 80 apply equally well to the remaining transporter conduit means 82, 84 and 86. Further, it should be evident that the invention could be practiced in combination with any other engine requiring, for example, five, six eight or any number of such transporter conduit means for supplying fuel to its respective engine combustion chambers.

It should be pointed-out that it has also been discovered that in the practice of the invention optimum results are obtained if all of the fuel-air emulsion transporter conduit means are of substantially equal effective length while being as short as possible commensurate with the existing conditions.

The invention, as should now be apparent, provides a single fuel metering valve member effective for metering fuel to a plurality of spaced fuel-receiving areas or ports of an engine and does it in a manner whereby, tests have shown that a fuel-delivery variation of less than two percent exists as between any two of the transporter conduit means and that in comparison to conventional prior art multipoint fuel injection systems an engine provided with a fuel metering and delivery system of the invention produces at least the same torque and exhibits improved fuel economy, cold and hot engine cranking performance and overall drivability, reduced engine exhaust emissions and a significantly increased lean (fuel) burn range of operation.

Further, in the preferred embodiment of the invention, the existing magnitude of the pressurized air supplied as to the air distributor 190, and therefore the pressure of the air provided to the respective passage means 200, 202, 204 and 206, is communicated to the fuel pressure regulator chamber 124 as to thereby have the pressure differential across the diaphragm means 128 that of the metering pressure differential across the nozzle or metering port means 274, 276, 278 and 280. In this way the fuel metering differential will remain substantially constant regardless of changes in the magnitude of the air pressure supplied to the air distribution chamber means 190. Although such communication of air pressure to regulator chamber 124 may be accomplished by any suitable means as, for example, by conduitry formed generally internally of housing means 88 and cover 126 which may, in fact, communicate as with the discharge end of conduit 174, such communication is depicted, especially for purposes of clarity, by a conduit means 368 situated generally externally and having one end communicating with chamber 124 via passage means 370 and having a second end communicating with air distribution chamber means 190 as via conduit or passage means 372.

Other Embodiments and Modificiations

Figure 15:
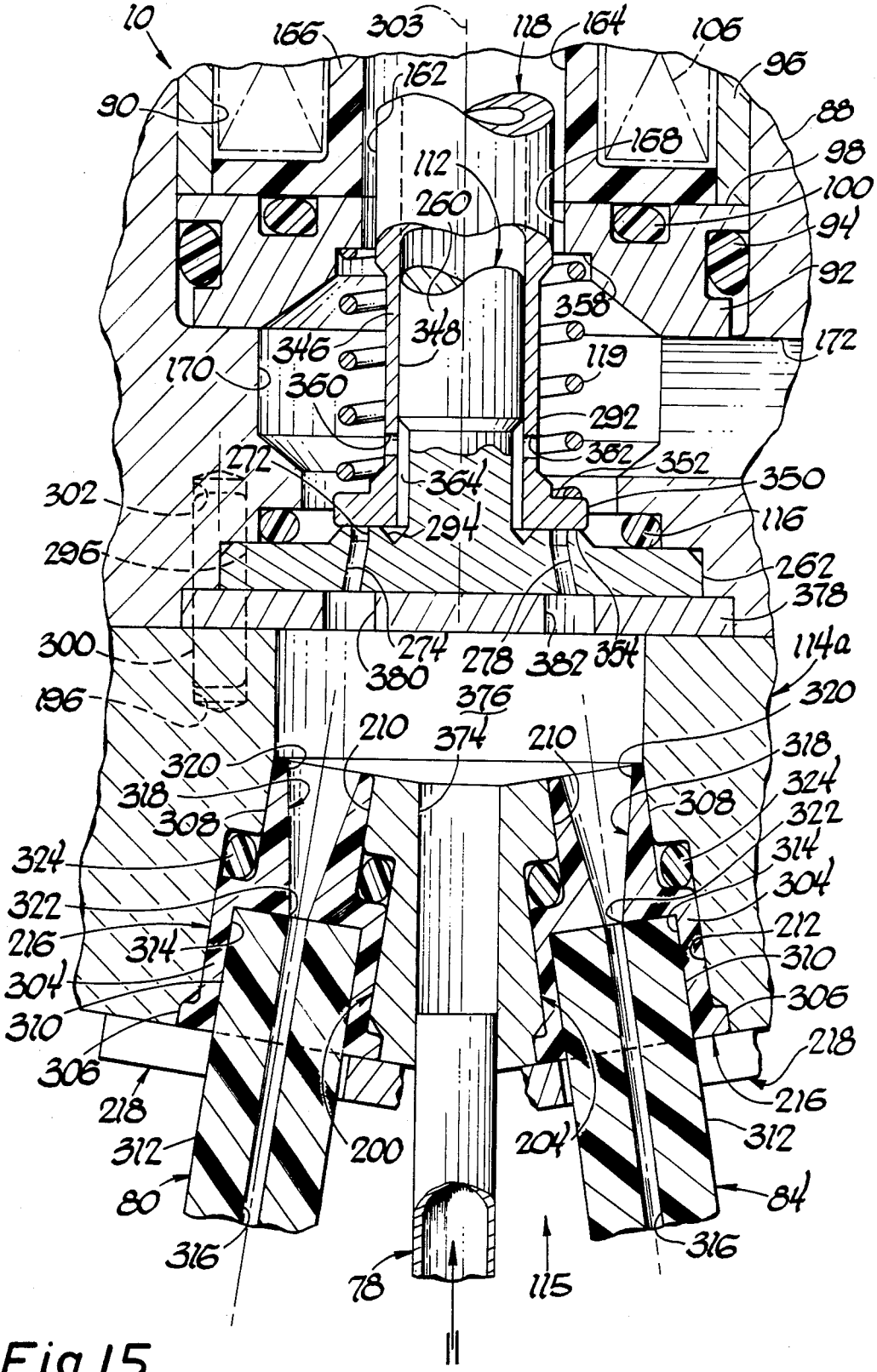
FIG. 15 is a view similar to that of FIG. 14 but illustrating another embodiment of the invention.

FIG. 15, a view somewhat similar to that of FIG. 14, illustrates another embodiment of the invention. Generally, in FIG. 15, all elements which are like or similar to those of the preceding Figures are identified with like reference numbers and only so much of the structure of said other embodiment is shown as is necessary to teach the differences between the preceding embodiment and that of FIG. 15. All other elements of FIGS. 1–14 not inconsistent with the embodiment of FIG. 15 may be considered as forming the overall fuel metering and distribution system of FIG. 15.

In the embodiment of FIG. 15, the main difference, as compared to the structures of FIGS. 2 and 14, is that the supply of pressurized air is delivered to a point between the four transporter conduit means (two of which are shown at 80 and 84) instead of to an area radially outwardly as the air distribution chamber 190 of FIGS. 2, 3 and 14. That is, in the embodiment of FIG. 15 the conduit means 174 could be eliminated and the air supply conduit means 78 placed in communication with a generally centrally located conduit or passage 374 leading to a generally centrally situated air distribution chamber means 376 which may be, as illustrated, of generally cylindrical configuration. In this embodiment the pressurized transporter air enters chamber means 376 as at the center thereof (between the respective axes of flow from the fuel metering ports or nozzles 274, 276, 278 and 280 to the aligned mixing chambers 318 of transporter conduit means 80, 82, 84 and 86) and then, in a generally fountain-like pattern, flows into the respective mixing chambers 318–318 and, as it flows toward such mixing chambers its direction of flow is substantially in the same direction as the flow of fuel metered by nozzle means 274, 276, 278 and 280.

A conduit (not shown) functionally equivalent to conduit 368 and passage 372 (FIG. 2) may be provided as to communicate directly with either air distribution chamber means 376 or conduit means 78 (or conduit means 374) and pressure regulator chamber 124 for the purposes described with reference to FIG. 2. An intermediate plate-like member 378, which may be of generally disk-like configuration may be provided as to be generally between the distributor body means 114*a* and the guide stem and nozzle member 112. If such plate-like member 378 is provided, a plurality of clearance apertures (two of which are shown at 380 and 382) are formed therethrough as to provide for the flow of metered fuel from the respective metering nozzle means through the air distribution chamber means 376 and into the aligned mixing chambers 318–318.

Figure 16:
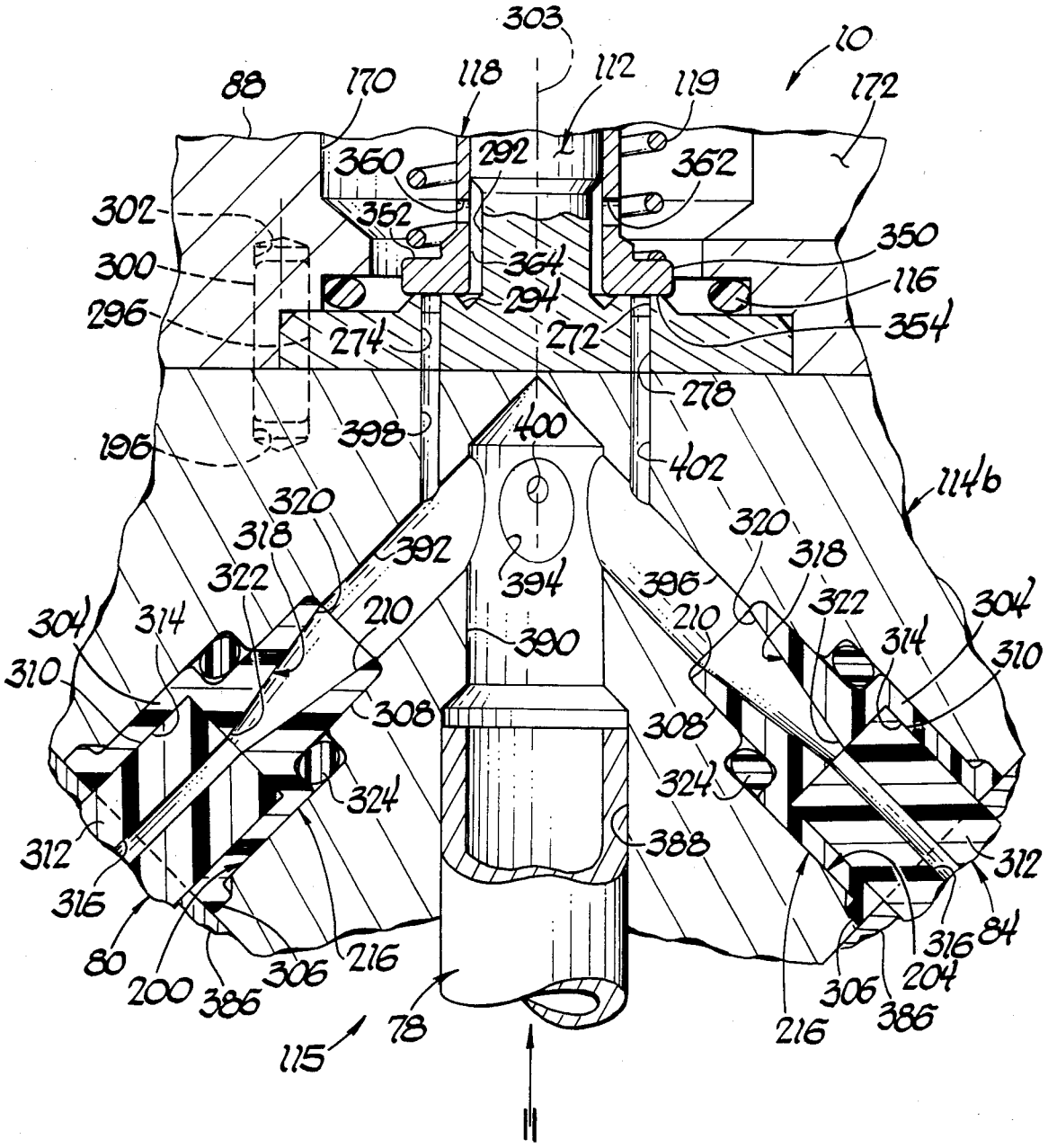
FIG. 16 is a view similar to either of FIGS. 14 or 15 and illustrating a further embodiment of the invention.

FIG. 16, a view somewhat similar to that of FIGS. 14 and 15, illustrates another embodiment of the invention. Generally, in FIG. 16, all elements which are like or similar to those of the preceding Figures are identified with like reference numbers and only so much of the structure of the embodiment of FIG. 16 is shown as is necessary to teach the differences between the preceding embodiments and that of FIG. 16. All other elements of FIGS. 1–15 not inconsistent with the embodiment of FIG. 16 may be considered as forming the overall fuel metering and distribution system of FIG. 16.

Unlike the embodiment of FIG. 14 but similar to the embodiment of FIG. 15, in the embodiment of FIG. 16 the supply of pressurized air is delivered to an area generally between the four transporter conduit means (two of which are shown at 80 and 84) instead of to an area radially outwardly as the air distribution chamber 190 of FIGS. 2, 3 and 14. That is, in the embodiment of FIG. 16 the conduit means 174 (of FIG. 2) could be eliminated and the air supply conduit means 78 placed in communication with a generally centrally located conduit or passage 388 which, in turn, communicates with a centrally situated chamber portion 390. A plurality of conduit-like chamber portions (three of which are shown at 392, 394 and 396), positioned as to be radiating away from the axis 303, serve to respectively complete communication as between chamber portion 390 and the aligned mixing chambers 318–318 of transporter conduit means 80, 82, 84 and 86 (of which only 80 and 84 are shown). Such chamber portion 390 and conduit-like chamber portions 392, 394, 396 (and the one not shown but communicating with transporter conduit means 86) effectively define pressurized air distribution means functionally equivalent to that of the preceding embodiments.

In the structure of FIG. 16 it is also preferred that the fuel metering nozzle or port means 274, 276, 278 and 280 (of which only 274 and 278 are shown) be formed as to be directed parallel to axis 303 instead of inclined as in the preceding embodiments. The distribution body or housing means 114*b* is provided with a plurality of passages, three of which are shown at 398, 400 and 402, which are respective aligned extensions of nozzle portions 274, 276, 278 and 280 and respectively communicate with the branching portions of the air distribution chamber means. The fuel metering pressure differential exists across such passages 398, 400 and 402, and respective aligned portions 274, 276, 278 and 280, thereby effectively making each set of aligned passage portions a fuel metering nozzle or port means.

In comparison to the preceding embodiments, it can be seen that in the structure of FIG. 16 the pressurized air flows first into the air distribution chamber portion 390 from where it is caused to flow radially outwardly and downwardly (as viewed in FIG. 16) through air distribution chamber portions 392, 394, 396 (and the one not shown but directly opposite to 394) to the respective mixing chambers 318–318 of transporter conduit means 80, 82, 84 and 86. While so flowing, the pressurized air impinges upon the metered fuel, discharged from the respective fuel metering nozzle means, in a somewhat tangential-like manner sweeping such fuel into the respective mixing chambers 318–318.

Suitable retaining or clamping means 386 may of course be provided for maintaining the respective transporter conduit means, as 80 and 84, in assembled relationship to the distributor housing or body means 114*b*.

In the structure of FIG. 16, a conduit (not shown) functionally equivalent to conduit 368 and passage 372 (FIG. 2) may be provided as to communicate with the air distribution chamber means, as, for example, at air distribution chamber portion 390, and pressure regulator chamber 124 for the purposes described with reference to FIG. 2.

Figure 17:
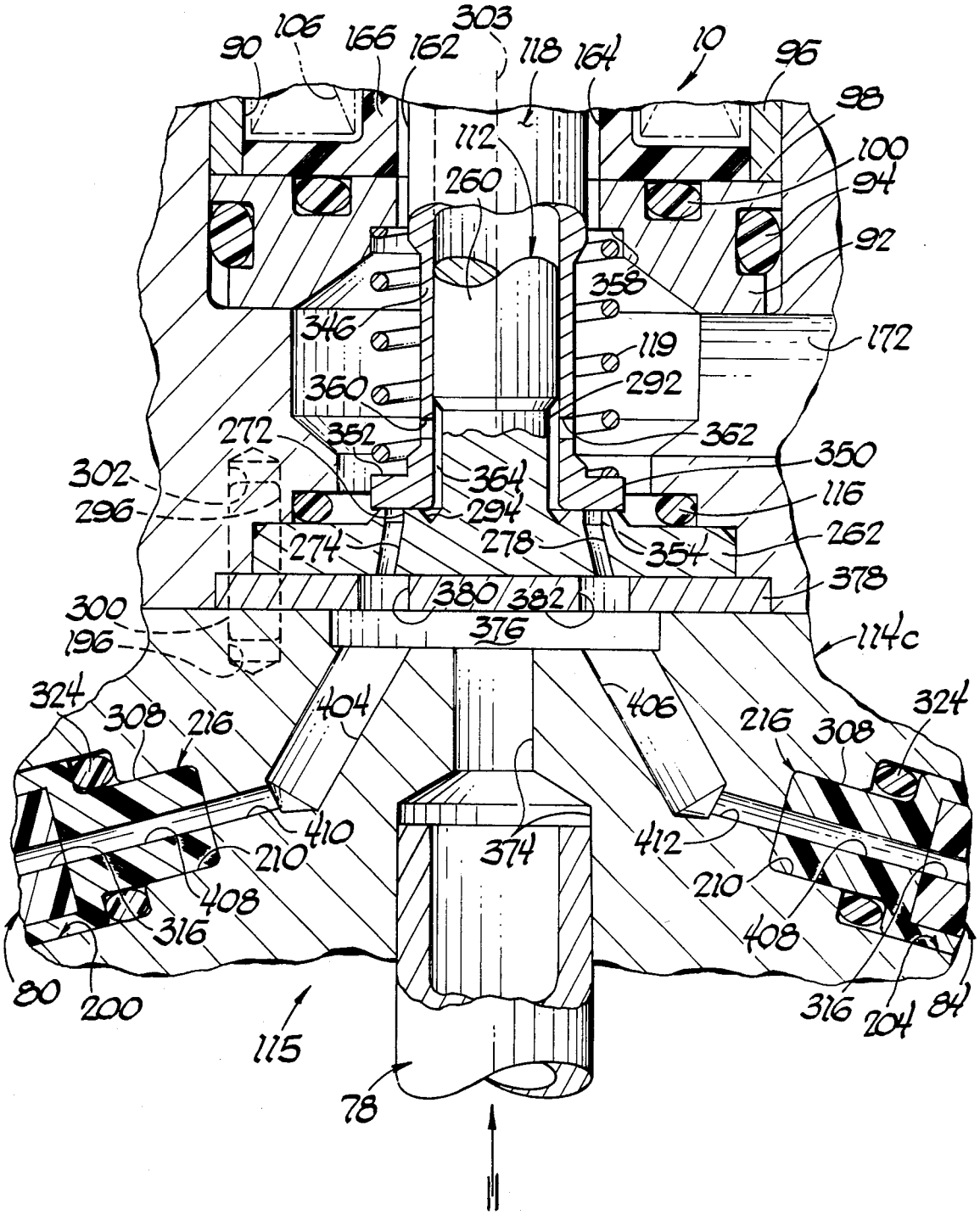
FIG. 17 is a view similar to that of either FIGS. 14, 15 or 16 and illustrating yet another embodiment of the invention.

FIG. 17, a view somewhat similar to that of FIGS. 14, 15 and 16 illustrates a further embodiment of the invention. Generally, in FIG. 17, all elements which are like or similar to those of the preceding Figures are identified with like reference numbers and only so much of the structure of the embodiment of FIG. 17 is shown as is necessary to teach the differences between the preceding embodiments and that of FIG. 17. All other elements of FIGS. 1–16 not inconsistent with the embodiment of FIG. 17 may be considered as forming the overall fuel metering and distribution system of FIG. 17.

Unlike the embodiment of FIG. 14 but similar to the embodiments of FIGS. 15 and 16, in the embodiment of FIG. 17 the supply of pressurized air is delivered to an area generally between the four transporter conduit means (two of which are shown at 80 and 84) instead of to an area radially outwardly as the air distribution chamber 190 of FIGS. 2, 3 and 14. That is, in the embodiment of FIG. 17 the conduit means 174 (of FIG. 2) could be eliminated and, similarly to the embodiment of FIG. 15, the air supply conduit means 78 placed in communication with a generally centrally located conduit or passage 374 leading to a centrally situated air distribution chamber means 376 which may be, as illustrated, of generally cylindrical configuration.

A plurality of conduit-like chambers (two of which are shown at 404 and 406) are formed in distributor housing means 114*c* as to respectively interconnect the air distribution chamber means 376 with each of the transporter conduit means, of which two are shown at 80 and 84.

In the embodiment of FIG. 17 the respective end fittings 216–216 of the transporter conduit means (two being shown at 80 and 84), are shown as somewhat modified in comparison to the end fittings of the preceding embodiments. That is, instead of the mixing chamber 318 of each of such end fittings (FIGS. 14–16), the end fittings 216 of FIG. 17 are formed with a passageway 408 which may be of a cross-sectional flow area and configuration conforming to passage 316. Further, body or housing means 114*c* has a plurality of intermediate passages or conduits, two of which are shown at 410 and 412, which are preferably of a cross-sectional flow area and configuration substantially equal to that of passages 408. As depicted the said intermediate passages serve to complete communication between respective ones of the conduit-like chambers (as 404 and 406) and respective ones of the transporter conduit means (as 80 and 84). In such an arrangement it is preferred that the axes of: the nozzle or metering port means 274; the conduit-like chamber 404; the intermediate conduit 410 and passage or conduit 408 all be contained in a single plane which also contains the axis 303. The same relationship would apply to 278, 406, 412 and 408 of transporter conduit means 84 as well as to all other transporter conduit means and associated conduit-like chambers and intermediate conduits.

Further, as depicted, in the arrangement of FIG. 17 all of the conduit-like chambers (404, 406) are formed as to be downwardly (as viewed in FIG. 17) extending from air distribution chamber means 376 and, at the same time, progressing angularly away from axis 303. The intermediate conduits (410, 412) are also formed at an angle with respect to axis 303 but of a magnitude greater than that of chambers 404, 406.

In operation, the pressurized air in distribution chamber means 376 flows into each of the conduit-like chambers 404, 406 (and all others not shown) where it mixes with the metered fuel discharged from the nozzle or metering means 274, 278. In other words, the mixing function performed by the mixing chambers 318 of FIGS. 14–16 is, in the embodiment of FIG. 17, performed by the conduit-like chambers 404, 406 formed in housing means 114*c*.

Suitable retaining or clamping means may of course be provided for maintaining the respective transporter conduit means, as 80 and 84, in assembled relationship to the distributor housing or body means 114*c*.

Figure 18:
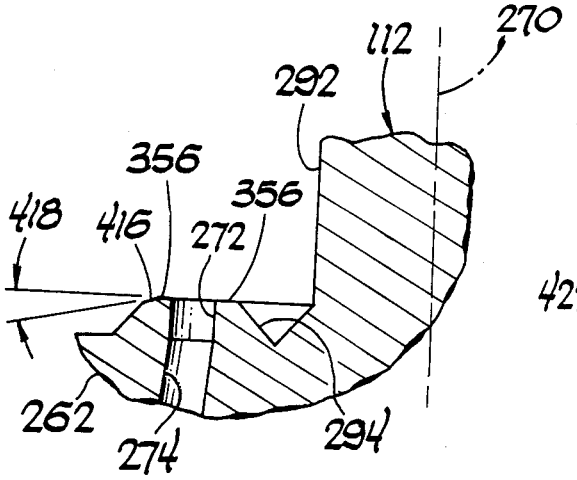
FIG. 18 is a view of an enlarged fragmentary portion, in cross-section, of one of the elements shown in any of FIGS. 2, 12, 14, 15, 16, and 17 and illustrating a modification thereof.

FIG. 18 illustrates in further enlarged view a fragmentary portion of one of the members, shown in the preceding embodiments, in modified form. More particularly, in FIG. 18 the head or nozzle end 262 of guide stem and nozzle member 112 is shown modified by forming a relief-like chamfer or downwardly inclined surface 416 annularly about what would otherwise be the full radially outer seating surface 356. The angle of such surface 416 need not be large and may be in the order of 1.0°, depending downwardly and radially outwardly as depicted in FIG. 18 at 418, from the horizontal or in the order of 89.0° with respect to axis 270. The surface 416 is formed as to intersect with the radially outer portion of seating surface 356 at a location which is as close to the annular fuel distribution recess or chamber 272 as practically possible without breaking into such recess means 272 thereby leaving a very narrow annular seating surface 356 immediately radially outwardly of the annular fuel chamber means 272. This modification results in enhanced fuel flow from an area radially outwardly of and into annular recess 272 as well as enhanced seating and sealing as between the remaining very narrow annular seating surface 356 and the juxtaposed valve seating surface 354.

The modification disclosed by FIG. 18 may be incorporated into any of the embodiments disclosed in FIGS. 2, 14, 15, 16 and 17.

Figure 19:
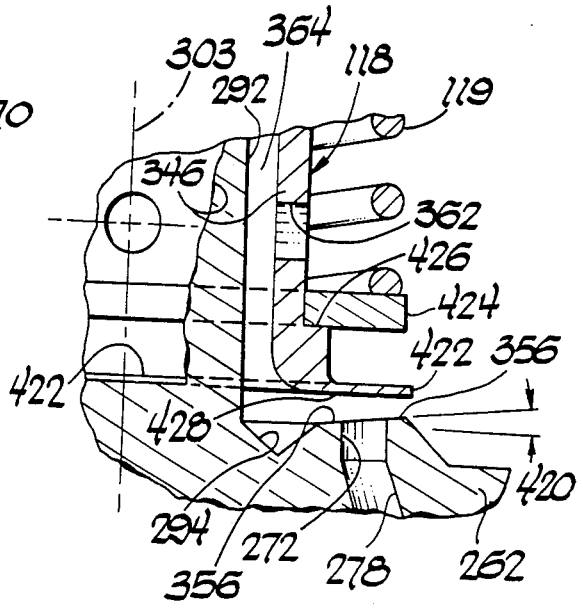
FIG. 19 is an enlarged view of a fragmentary portion of the structure shown generally in any of FIGS. 2, 12, 14, 15, 16, and 17 and illustrating modifications of the depicted elements.

FIG. 19 illustrates in relatively enlarged view fragmentary portions of some of the elements, shown in the preceding embodiments, in modified form. More particularly, in FIG. 19 both the generally tubular valving member 118 and the guide stem and nozzle member 112 are shown as modified. The head or nozzle body portion 262 of member 112 is shown modified by forming both radially inner and radially outer seating surface means 356–356 to be inclined progressively upwardly (as viewed in FIG. 20) as such extend radially outwardly of axis 303. Such inclined seating surface portions may be considered as generally conical and the angle thereof, from the horizontal, need not be large and may be in the order of 1.0° as generally depicted at 420. This would be equivalent to an angle in the order of 89.0° with respect to the axis 303. The valving member 118 is modified by having the lower radiation flange 422 thereof made very thin as to be resiliently deflectable upwardly (as viewed in FIG. 19) from the normal configuration illustrated. Such normal configuration exists when the valve member 118 is in its depicted opened position. The spring 119, instead of directly engaging the flange as in the embodiments of FIGS. 2, 14, 15, 16 and, operatively engages an annular spring seat member 424 piloted on the axially extending tubular portion of valve member 118 and axially abutting against a cooperating annular shoulder 426 carried by member 118.

In the modification of FIG. 19, when spring 119 returns valve member 118 to its closed or seated condition against the seating surface means 356–356 the flange 422 seating surface 428 first strikes the highest portion of seating surface 356–356 and undergoes resilient deflection as the valve member 118 continues its downward movement. Such resilient deflection and downward movement continue until the valve seating surface 428 is sealingly seated against both the radially inner and radially outer annular portions of seating surface means 356–356. The resilient flexibility of flange means 422 enables the seating surface thereof to better conform to the seating surface means 356–356.

The modification disclosed by FIG. 19 may be incorporated into any of the embodiments disclosed in FIGS. 2, 14, 15, 16 and 17.

Figure 20:
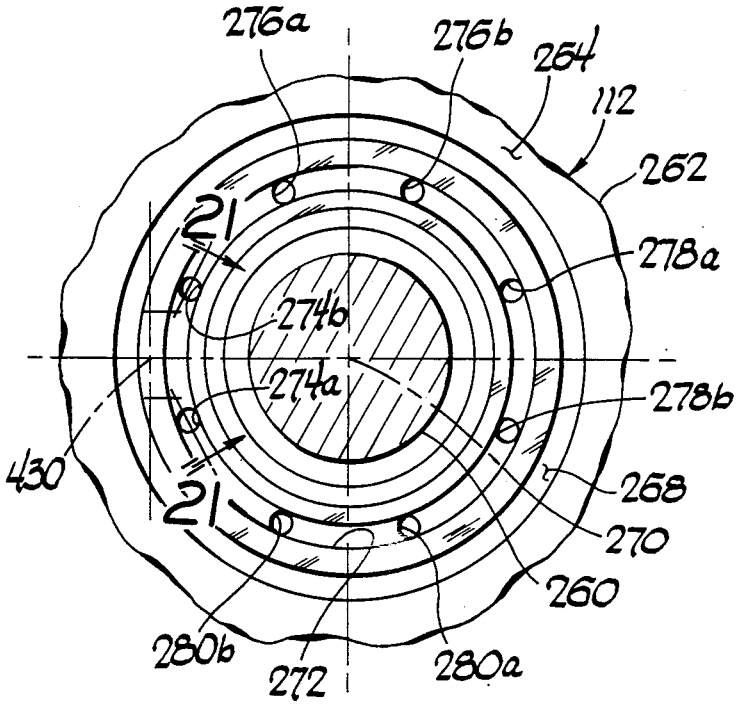
FIG. 20 is a view similar to that of FIG. 13 and illustrating a modification thereof.
Figure 21:
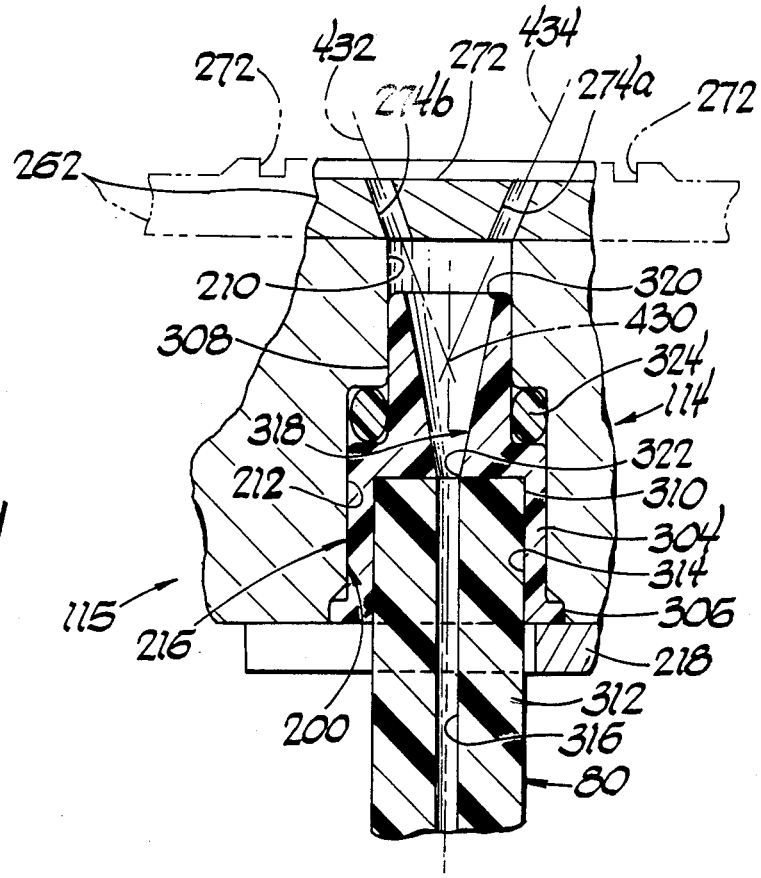
FIG. 21 is a cross-sectional view taken generally on the plane of line 21—21 of FIG. 20 and looking in the direction of the arrows.

FIGS. 20 and 21 illustrate a further modification. FIG. 20, is a view similar to FIG. 13 but illustrating a modified form of the structure of FIG. 13. Generally, the modification of FIG. 20 contemplates the provision of a plurality of nozzle or fuel metering ports discharging metered fuel to respective ones of the transporter conduit means 80, 82, 84 and 86. In comparing the structures of FIGS. 13 and 20, generally, the fuel metering nozzle means or ports: 274*a* and 274*b* of FIG. 20 would replace the single nozzle means 274 of FIG. 13; 276*a* and 276*b* of FIG. 20 would replace the single nozzle means 276 of FIG. 13; 278*a* and 278*b* of FIG. 20 would replace the single nozzle means 278 of FIG. 13; and 280*a* and 280*b* of FIG. 20 would replace the single nozzle means 280 of FIG. 13.

With greater detail to both FIGS. 20 and 21 and employing the pair of fuel metering nozzles or ports 274*a* and 274*b* as typical of the other pairs of fuel metering nozzles, let it be assumed that point 430 in FIG. 20 is a projection, parallel to axis 270, of a point on the axis of the mixing chamber 318 of an end fitting 216 of a related transporter conduit means 80. Such a corresponding point 430 may exist as at a location depicted in FIG. 21. The combined FIGS. 20 and 21 and the relative radial (with respect to axis 270) locations of the inlet ends of metering nozzles 274*a* and 274*b* and that of point 430 indicate that the passage means 200 is preferably inclined with respect to axis 270 as in the manner depicted in FIG. 14 with the consequent identical inclination of end fitting 216. However, for ease and clarity of illustration, the passage means 200 and end fitting 216 are depicted as being directly vertically extending.

As best shown in FIG. 21, it can be seen that the pair of metering nozzle means 274*a* and 274*b* are formed so that the fuel metered thereby is discharged as along the respective axes 432 and 434 ideally meeting as at the assumed point 430. The pressurized air, provided by means 14 of FIG. 1, may of course be directed to the inlet of mixing chamber means 318 as by any of the arrangements already disclosed as well as other arrangements as will become apparent in view of the teachings hereof.

In the preferred form of the modification as contemplated by FIGS. 20 and 21 metering nozzle means 274*a* and 274*b* are formed as to be skew with respect to axis 270. That is, they are each directed generally radially outwardly, as in the manner generally depicted in FIG. 14, and at the same time directed generally toward each other as depicted in FIG. 21.

In the preferred embodiment of the modification of FIGS. 20 and 21, the inlet ends of the fuel metering nozzle means 274*a*, 274*b*, 276*a*, 276*b*, 278*a*, 278*b*, 280*a* and 280*b* are angularly equidistantly spaced about axis 270 generally within the fuel manifold or recess means 272. By so doing each of the respective inlet ends is assured of equal access to the fuel as flows in and to fuel recess 272. Further, by providing a plurality of metering nozzle means for each transporter conduit means, there is a better fuel distribution and fuel flow within the fuel recess as compared to the use of a single metering nozzle which, of course, would be spaced a greater distance from the next adjacent metering nozzle as depicted in FIG. 13.

Accordingly, the provision of multiple fuel metering nozzle or port means may be incorporated in any of the embodiments of FIGS. 2, 14, 15, 16 and 17.

Figure 22:
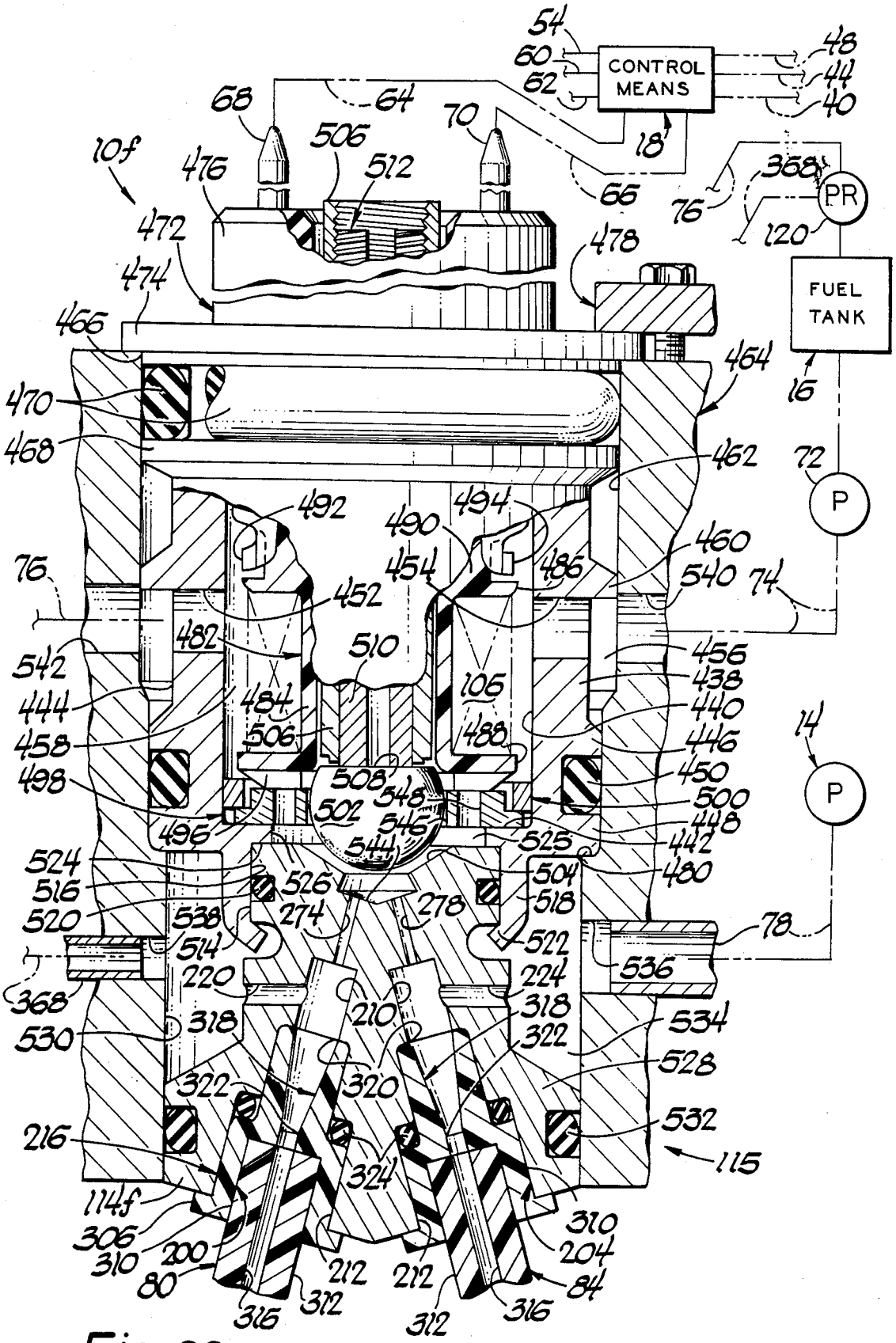
FIG. 22 is a view similar to that of either FIGS. 14, 15, 16, 17 or 19 and illustrating another embodiment of the invention.

FIG. 22 illustrates still another embodiment of the invention. As hereinbefore, like or similar elements or details are, at least for the most part, identified with like reference numbers. Only so much of the structure of FIG. 22 is disclosed as is necessary to fully understand it and the operation thereof. Other elements in any of the preceding Figures, including FIG. 1, which are not inconsistent with the structure of FIG. 22 may be considered as forming a part thereof.

Referring now in greater detail to FIG. 22, the fuel metering and distribution system 10*f* is illustrated as comprising a generally tubular cup-shaped main body or housing means 438 which is suitably open (not shown) at its upper end, as viewed in FIG. 22, as to thereby receive through said open end at least some of the components or elements illustrated as being situated therewithin.

As generally depicted, the housing means 438 is preferably provided with an axially extending inner cylindrical surface 440 which may terminate as in an annular flange-like or shoulder surface 442 which is directed radially inwardly from the inner cylindrical surface 440.

The external surface 444 of housing means 438 is also of generally cylindrical configuration and, among other things, is provided with annular flange-like portions 446 and 448 which cooperate to define an annular recess which, in turn, is effective for holding an O-ring seal 450.

A plurality of generally radially directed angularly spaced apertures or passages, two of which are shown at 452 and 454, are formed through housing means 438 and serve to complete communication as between an annular recess 456 and the interior 458 of housing or body means 438. The annular recess 456 may be defined generally by an annular flange portion 460, flange portion 446, the exterior of body means 438 and the inner surface 462 of the associated support structure 464.

The upper end of housing means 438 is preferably provided with radiating annular flange portions 466 and 468 which cooperate to define an annular recess therebetween in turn serving to hold an O-ring seal 470. The housing means 438 may effectively extend upwardly and be at least partially contained as within dielectric end cover means 472 which may comprise a disk-like member or portion 474 and an upwardly directed cylindrical extension 476. Suitable clamping or retaining means 478, operatively engaged as with end portion 474, serves to hold the assembly 10*f* in assembled condition to the associated support structure 464 as by axially abutting the flange 448 against a cooperating annular shoulder portion 480 of the support structure 464.

A bobbin 482 is depicted as comprising a centrally disposed tubular portion 484 with axially spaced radially extending end walls 486 and 488 along with a generally upwardly projecting portion 490 which, among other things is operatively structurally connected to respective one ends 492 and 494 of electrical terminals 68 and 70. The field coil 106 is wound generally about tubular portion 484 and axially contained between end walls 486 and 488. The ends of the wire forming the electrical coil 106 are electrically connected to ends 492 and 494, respectively, of electrical terminals 68 and 70. In the preferred embodiment a plurality of foot-like portions 496 are carried by the end wall 486 of bobbin 482 and are preferably angularly spaced about the axis of tubular portion 484 and, further, function as abutment means for axially abutting against the upper surface of an annular locator means 498.

An annular ring like member 500, press-fitted against inner surface means 440 of housing means 438, serves to maintain locator means 498 in a preselected position. As generally depicted, the locator means 498 serves to maintain a valve member 502, generally contained by locator 498, in a position to obtain optimum seating characteristics as between the valve member 502 and a cooperating seating surface 504.

A generally tubular pole piece 506 extends downwardly into the tubular portion 484 of bobbin 482 and is preferably provided with a stepped annular pole piece end face which may be spaced from a flatted surface 508 of the depicted ball valve member 502, when such ball valve member is seated against surface means 504, as well as being similarly but spaced less from the flatted surface 508 when the valve 502 is in its open position as generally depicted. The pole piece 506 may be threadably secured as to structure contained generally within the elevationally depicted portion of FIG. 22 whereby the relative axial position of the pole piece 506 may be adjusted as to, for example, determine the desired gap between surface 508 and the pole piece end face.

A tubular guide and stop pin 510 of preferably nonmagnetic stainless steel, is slidably received with the core or pole piece means 506 and is normally resiliently urged downwardly (as viewed in FIG. 22) against valve 502 to urge said valve member into seated engagement with the associated seating surface means 504.

A spring (not shown) received as within the bore of pole piece means 506 is axially contained between and against the guide pin 510 and one end of a spring adjuster screw 512 which is threadably engaged with pole piece means 506 and suitably sealed as by O-rings to prevent leakage therepast as is well known in the art. The purpose of such spring adjuster screw 512 is, of course, as is well known in the art, to attain the desired spring pre-load on guide and stop pin 510.

A distributor body or housing means 114*f* is illustrated as comprising a generally cylindrical upper portion 514 which is closely received within a cooperating cylindrical recess 516 formed as in a depending portion 518 of housing means 438. A groove or recess formed in the upper portion 514 serves to generally retain an O-ring seal 520 which precludes fluid flow therepast. The housing means 114*f* may be retained to the housing means 438 as by spinning or otherwise forming-over the end of depending portion 518 as generally depicted at 522 and, in so doing, axially seat the upper end (as viewed in FIG. 22) of portion 514 against surface 524 of an inwardly directed annular flange portion 526 of housing means 438.

The relatively lower portion 528 of housing or body means 114*f* is illustrated as being of cylindrical configuration and of a diameter relatively greater than that of upper body portion 514. The lower body portion 528 is depicted as being closely received as within a cooperating cylindrical opening 530 formed as in the associated support structure 464. A groove or recess formed in the lower portion 528 serves to retain an O-ring seal 532 which precludes fluid flow therepast.

As generally illustrated, an annular chamber 534 is defined generally about the distributor body means 114*f* and the inner wall of cylindrical opening 530. A passage 536, formed as in support structure 464, communicates with chamber means 534 and suitably receives conduit means 78 leading to the air supply or air pump means 14. A second passage means 538, also formed as in support structure 464, also communicates with chamber means 534 and suitably receives conduit means 368 which, as in the manner described with reference to FIG. 2, leads to and communicates with pressure regulator means 120 as to function to maintain a substantially constant pressure differential across the metering nozzle or port means, two of which are illustrated at 274 and 278. The associated support structure 464 may also be provided with passages 540 and 542 both of which communicate with annular space 456 and the interior 458 as via conduit or passage portions 452 and 454. Passage 540 is, in turn, placed in communication with fuel supply pump means 72 via conduit means 74 while passage 542 is placed in communication with the pressure regulator means 120 as via conduit means 76.

In the illustrated form of the embodiment of FIG. 22, the valve member 502 is preferably formed of chrome steel to very exacting dimensional requirements which are often commercially available. Further, as should be apparent, the valve member 502 also acts as the armature means in the overall metering assembly 10 and when coil means 106 is energized the flatted ball valve member 502 is moved to its fully opened condition or position as generally depicted in FIG. 22.

In assembling the structure of FIG. 22, when valve member 502 is fully seated (closed) on cooperating seating surface means 504 the guide member 498 is placed about it so as to have the valve member 502 slidably contained within a passage 546 formed through guide 498. The guide passage 546 may be of a size providing a clearance in the order of 0.0005 inch as between itself and the ball valve member 502 thereby greatly assisting in the proper seating of the valve member 502 against surface 504 whenever valve member 502 is moved to its closed position as by guide and stop pin means 510. When such a relationship is attained, the guide member 498 may be frictionally locked in place as by a frictionally engaging annular retaining ring 500 pressed into chamber 440 and axially against a stepped annular shoulder or flange of locator or guide member 498. A plurality of generally free-flowing passages 548 are also formed through locator or guide 498 in order to have a generally unrestricted flow of superatmospheric fuel into the chamber area 525 generally defined within the flange portion 526, the upper end of body or housing portion 114*f* and the seating surface 504.

Further, in the preferred form of the embodiment of FIG. 22 a fuel chamber 544, is formed, as a counterbore or recess, into the upper end of distributor body means 114*f* so that when the valve member 502 is seated the fuel chamber 544 is prevented from communicating with the fuel upstream of the closed valve member 502. The fuel metering nozzle or port means 274, 276, 278 and 280 (of which only 274 and 278 are illustrated) are respectively placed in communication with and between fuel chamber means 544 and the aligned passage portions 210–210 of respective passage means 200, 202, 204 and 206 as in accordance with the teachings herein presented with respect to, for example, FIGS. 1–14. (The nozzle or metering port means 274 and 278 along with their respective air supply means and transporter conduit means are shown as being typical of any number of such which may be desired in any particular fuel system.)

Generally, fuel under superatmospheric pressure supplied by pump means 72 flows into annulus 456 and through radial ports or passages 452, 454 into the interior 458 from where it flows through the spaces between the plurality of legs 496 and through the passages 548–548 of guide means 498 into chamber 525. (The regulation of the magnitude of the pressure of the fuel supplied to the interior is, of course, achieved in the manner as described with reference to FIGS. 2 and 14.) As the armature valve 502 is moved upwardly off its cooperating seat 504, fuel passes between the opened valve 502 and seat 504 and into fuel chamber means or fuel distribution means 544. The pressurized fuel thusly provided to fuel chamber means 544 is then metered through fuel metering nozzle or port means 274 and 278 and into and through passage portions 210. The direction of flow of such metered fuel is preferably in axial alignment with the mixing chamber means 318.

At the same time air, under superatmospheric pressure supplied as by pump means 14, flows from conduit means 78 into air distribution chamber or annulus means 534 from where the pressurized air flows through passages 220 and 224 as to passage portions 210–210 of respective passage means 200 and 204. The angle of entry of such air into passage portions 210–210 may, of course, be changed to be more nearly directed toward the mixing chamber means 318–318. In any event, the metered fuel and the air undergo a mixing action within the respective mixing chambers 318–318 and flow as a fuel-air emulsion, through the respective fuel transporter conduit means 80, 84 to the engine in the manner described with reference to, for example, FIGS. 2 and 14.

When the cyclically energized coil means 106 is de-energized the associated spring means (not shown but well known in the art and functionally equivalent to spring 119) urges the guide member 510 and ball valve member 502 to its closed or seated condition against valve seat 504 thereby cyclically terminating metered fuel flow through the fuel metering nozzle or port means 274 and 278.

Figure 23:
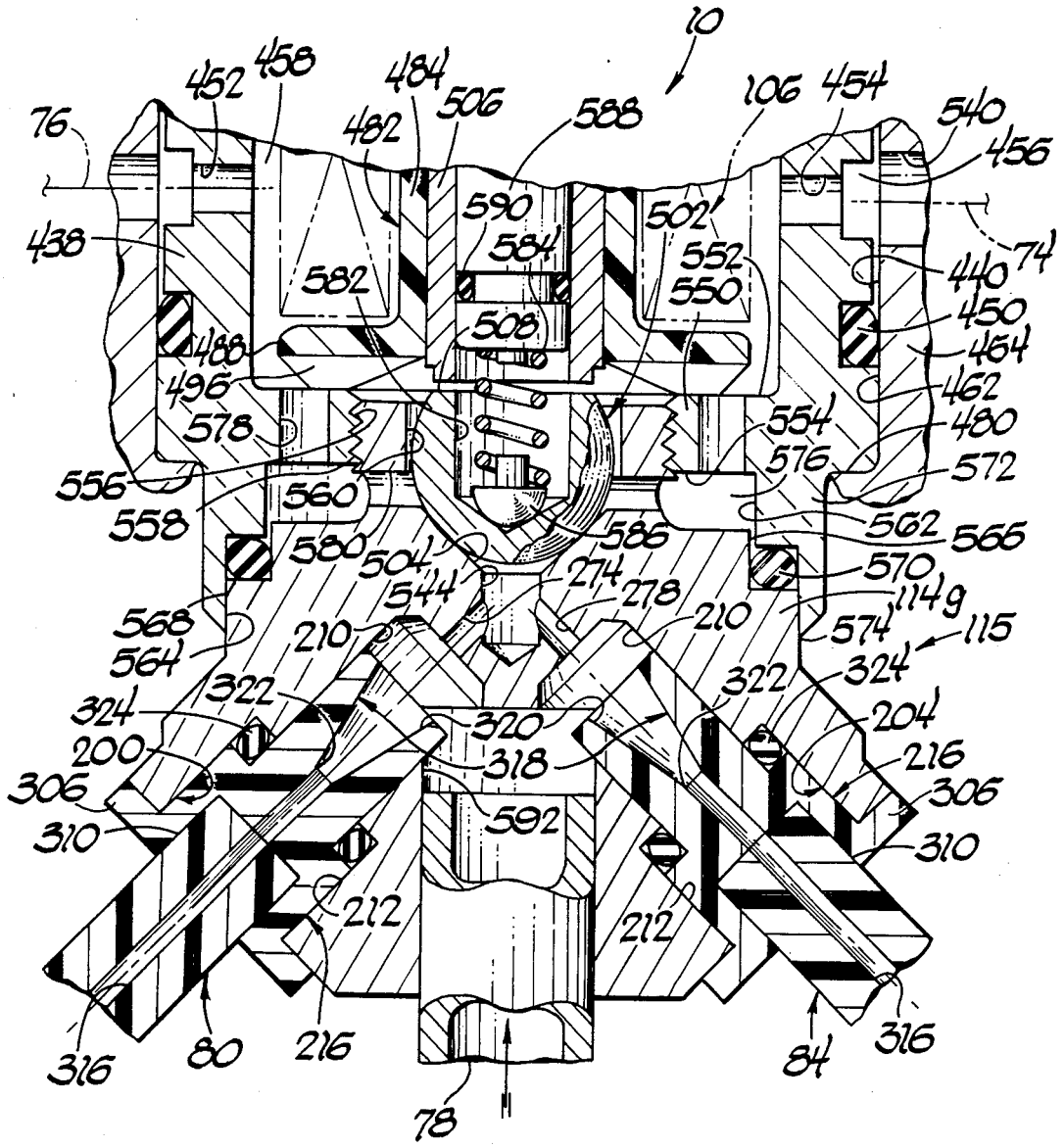
FIG. 23 is a view similar to that of FIG. 22 and illustrating a still further embodiment of the invention.

FIG. 23 illustrates, in fragmentary view, a still further embodiment of the invention. Generally, as hereinbefore, like or similar elements or details are, at least for the most part, identified with like reference numbers. Only so much of the structure of FIG. 23 is disclosed as is necessary to fully understand it and the operation thereof. Other elements in any of the preceding Figures, including FIG. 1, which are not inconsistent with the structure of FIG. 23 may be considered as forming a part thereof.

In at least some respects, the embodiment of FIG. 23, is a modification of the structure of FIG. 22 in the same sense as, for example, the embodiment of FIG. 15 may be considered a modification of the structure of FIG. 14.

Referring in greater detail to FIG. 23, a lower situated radially inwardly directed flange portion 550 has upper and lower disposed surfaces 552 and 554 along with a generally centrally formed threaded portion 556.

The generally lower disposed distributor body or housing means 114*g* may be comprised of an upper generally axially extending portion which is provided with an externally threaded portion 558 threadably engaging the threaded section 556. A generally cylindrical opening or passage 560 (functionally equivalent to 546 of FIG. 22) is formed in the upper end of distributor housing means 114*g* and serves (as 546 of FIG. 22) as a guide or locator means for ball valve 502 in its movement toward valve seating surface means 504.

The body means 438 is illustrated as comprising a first generally cylindrical opening 562 and a second cylindrical opening 564 of relatively enlarged diameter. The distributor body means 114*g* is somewhat similarly formed with a first outer cylindrical surface 566 and a second outer cylindrical surface 568. As generally depicted, the first outer cylindrical surface 566 can be rather loosely received within the cylindrical opening 562 while the second outer cylindrical surface 568 is closely received by and piloted within the cylindrical opening 564. The opposed annular shoulders created by the inner cylindrical surfaces of openings 562 and 564 and the outer cylindrical surfaces 566 and 568 serve to contain an O-ring seal 570 which prevents fluid flow therepast.

At assembly, the body means 114*g* may be threadably rotated, as by threads 556, 558, in order to attain the desired stroke of the armature valve member 502. During such threadable rotation the housing means 114*g* is axially piloted by the cooperating cylindrical surfaces 564 and 568. When the desired stroke is attained, the body means 114*g* is preferably locked against relative rotation as by sonic welding of the depending portion 572 to housing 114*g* as at 574. When thusly assembled an annular chamber 576 is formed generally immediately below the flange portion 550 and a plurality of ports or passages 578–578 formed through flange portion 550 serve to provide unrestricted fuel flow from interior space 458 to chamber means 576. A second plurality of ports or passages 580–580 provide for unrestricted fuel flow from annulus 576 to generally the interior of the guide passage means 560 and, when valve 502 is opened, to the fuel chamber means 544.

As depicted, the armature ball valve 502 may be provided with a diametrically extending bore 582 having a closed end which is situated at a location on a side of the center of curvature (of the spherical portion) which is opposite to the side at which such bore 582 is open. One end of a return spring 584 is shown engaged with a spherical-like end thrust member 586, engaging the closed end of the bore 582, while the opposite end of spring 584 is operatively connected to the end of an adjustably positioned spring preload member 588 which is preferably provided with a fluid flow sealing O-ring 590.

The housing means 114*g* is shown provided with a bore or passage 592 formed therein which extends inwardly, between the passage means 200, 202, 204 and 206 (of which only 200 and 204 are shown), a distance sufficient to break through and communicate with each of the passage portions or sections 210–210. Such bore or passage 592 may be considered as the air distribution means since it serves to provide superatmospheric air to each of such passage portions 210–210 and the respective transporter conduit means 80, 82, 84 and 86 of which only 80 and 84 are shown.

As in the preceding embodiments, when coil 106 is cyclically energized and armature valve 502 is thusly cyclically opened, fuel under superatmospheric pressure supplied via conduit means 74 flows from annulus 576, passages 580–580 and into fuel chamber means 544 from where it is metered through the metering nozzle or port means 274 and 278. The metered fuel is discharged into and through passage portions 210–210 and toward the respective mixing chambers 318–318 of transporter conduit means 80 and 84. At the same time air under superatmospheric pressure supplied via conduit means 78 flows from air distribution chamber means 592 to each of the passage portions 210–210 and into the respective mixing chambers 318–318 of transporter conduit means 80 and 84. The directions of flow of the air and the fuel, as such flows enter the mixing chambers 318–318 are in the same general axial direction. The intermixing of fuel and air and the resulting fuel-air emulsion and the flow thereof through the respective transporter conduit means (as 80, 82, 84 and 86) is that as described with reference to the preceding embodiments.

A conduit (not shown) functionally equivalent to conduit 368 (FIGS. 2 or 22) is preferably provided as to communicate, for example, with air distribution chamber 592 or conduit means 78 and the pressure regulator 120 (FIGS. 2 or 22) in the same manner and for the purposes described with reference to FIG. 2 (or FIG. 22).

Figure 24:
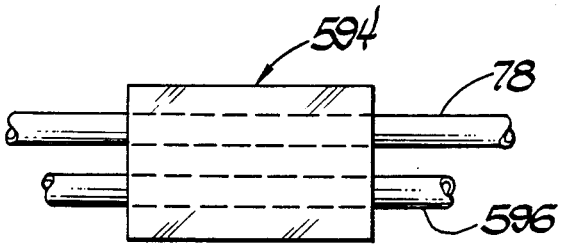
FIG. 24 is a schematic view of a fragmentary portion of structure employable in the practice of the invention.

FIG. 24, somewhat schematically, illustrates heat exchanger means 594 and portions of conduit means 78 and 596. The purpose of FIG. 24 is to illustrate that it is also contemplated that the superatmospheric air supplied, as via conduit means 78, may be heated prior to its introduction into the air distribution chamber means. By providing such heated air an even greater dispersion of the fuel particles within the fuel-air emulsion becomes possible.

Conduit 596 is intended to generically represent any suitable source of heat which may be available as, for example, the engine coolant system or engine exhaust system. However, it should be apparent that heat could also be supplied as by electrical heating means.

Further, even though not essential it is nevertheless preferred that when heated superatmospheric air is supplied, as contemplated by FIG. 24, that suitable heat insulating means be employed to prevent any possible undue heat transfer to the metering nozzle means. Such heat barrier means may, for example, take the form of either a temperature insulating means, a thermal sink means or means for rapid temperature transfer to associated heat sink means.

FIGS. 15 and 17 illustrate a plate-like member 378 which, with proper material selection as would be known in the art, would serve to preclude an excessive heat transfer to nozzle body means 262.

General Comments

As should be evident, the invention provides a fuel metering and distribution system wherein a single (for example duty-cycle operated) valve member is effective for simultaneously metering fuel to a plurality of engine cylinders through a like plurality of fuel transporter conduit means respectively communicating as with the induction passage means at the intake port means of such engine cylinders.

Also as should be apparent, the valving member of the invention, in its preferred embodiment, is of the duty-cycle type which may have an operating cycle ranging, for example, from 50 to 200 (or even more) cycles per second. Even though the fuel being metered is accordingly actually cyclically terminated and initiated, the net effect is to create what may be considered, for practical purposes, a continuous flow but of varying rates depending on the energization and de-energization of the coil means brought about by control means 18.

The invention, of course, could employ a supplied fuel pressure which would be regulated to a substantially constant magnitude and the superatmospheric air could be supplied at a substantially constant magnitude thereby resulting in a substantially constant fuel metering pressure differential. However, doing so would require the additional cost of two pressure regulators and the additional cost of calibration thereof. The preferred embodiments of the invention do not require such individual regulation of the magnitudes of the air pressure and fuel pressure. As already hereinbefore described, a constant fuel metering pressure differential is attained by a single pressure regulator which is exposed to and responsive to the pressure magnitudes of both the fuel to be metered and the air supplied to the discharge end of the fuel nozzle or port means.

In fact, in the preferred embodiments, the source of superatmospheric air would preferably be an electrically driven air pump the output pressure of which could be considered as non-regulated. The output air pressure of such pump means would only effectively increase as engine load and speed increased. For example, in certain successful tests conducted on apparatus employing teachings of the invention wherein four transporter conduit means were employed (with such transporter conduit means each having a flow passage of 0.80 mm. diameter cross-sectional flow area) in the range of idle engine operating conditions the pressure of the superatmospheric air supplied to the air distribution chamber means ranged in the order of from 21.0 p.s.i.g. to 26.5 p.s.i.g. while at full engine load operation the pressure of such superatmospheric air was in the order of 38.0 p.s.i.g. The pressure regulating means 120 was set as to continually provide a fuel pressure of a magnitude which would result in a constant metering pressure differential of 1.0 atmosphere employing the then sensed magnitude of the superatmospheric air pressure as a reference. Further, in such tests it was discovered and confirmed that generally as engine fuel demands increased the volume rate of flow of superatmospheric air decreased. For example, in such tests in the idle range of engine operation (and in the range of air pressures hereinbefore stated) the total volume rate of superatmospheric air flow was in the order of 500.0 $cm.^3$/sec. while at full engine load (and therefore maximum rate of metered fuel flow) the volume rate of superatmospheric air flow was in the order of 100.0 $cm.^3$/sec.

From this it can be appreciated that apparently with the fixed cross-sectional flow area of the respective transporter conduit means as the rate of metered fuel flow increases such fuel flow occupies an increasing amount of the space available in the passage of the transporter conduit means and to that extent diminishes the volume rate of superatmospheric air flowing therethrough. Therefore, as a natural consequence an increasing restriction to air flow through the transporter conduit means is realized, with increasing rates of metered fuel flow, thereby resulting in an increasing magnitude of the pressure of said superatmospheric air.

An additional benefit derived from this is that the greater volume rate of superatmospheric air flow as at idle engine conditions assures a greater sweeping action on the metered fuel and delivery thereof in a particle size most advantageous for the then engine conditions. However, as engine loads increase the relative percentage of metered fuel (within the transporter conduit means) also increases thereby, especially since the magnitude of the superatmospheric air also increases, reducing the response time of delivering the fuel needed to meet increased engine demands.

In comparing the invention to, for example, a system wherein atmospheric air were to be used instead of the superatmospheric air used in the invention, it can be seen that such a system employing atmospheric air would exhibit serious problems. For example, the transport time (that being the time required to transport the metered fuel from the metering orifice means to the inlet port means of the engine cylinder) of the atmospheric air system would be significantly longer than the transport time of the invention. Consequently, the response time (that being the time lapse from when, for example, increased metered fuel flow occurs at the metering valve and when such increased metered fuel flow actually reaches the intake port means of the engine cylinder) of the assumed atmospheric air system is significantly longer than the response time of the invention.

Further, since the operation of the assumed atmospheric air system is dependent upon a pressure differential created as between ambient atmosphere and engine intake or manifold vacuum, a major problem of such assumed atmospheric air system occurs when the engine is operating near or at wide open throttle (WOT) conditions. As is well known in the art, the magnitude of the engine intake or manifold vacuum greatly decreases at WOT and closely approaches the magnitude of ambient atmosphere. Therefore, just when a need for a significant if not greatest pressure differential exists for transporting the fuel to the cylinder, in the assumed atmospheric air system there is hardly any pressure differential between the atmospheric air and the induction manifold at the receiving cylinder. In contrast with the superatmospheric air of the invention, not only is the rate of metered fuel flow increased at WOT but the absolute pressure of the superatmospheric air is also increased thereby achieving excellent transport and response times.

As already stated, in the preferred embodiment, the superatmospheric air would be supplied by an electrically driven air pump; however, it should be made clear that it has also been determined that a mechanically driven air pump (as, for example, one driven by the engine) provides an adequate volume and superatmospheric pressure range of air flows and, therefore, such a mechanically driven air pump may be employed as the source for providing the superatmospheric air flow of the invention.

As should also be apparent, in the fuel metering system of the invention, there is no attempt to alternate metered fuel flow through a series of fuel transporter conduit means as to achieve fuel delivery to only an opening (or open) intake port of an engine cylinder as to thereby operate in a timed relationship to engine operation. The invention as herein disclosed, even though metering in a duty-cycle fashion, nevertheless, provides continual flows through all of the transporter conduit means since to do otherwise would needlessly complicate the overall operation, greatly increase the cost and not achieve any ultimate benefits.

Although only a preferred embodiment and other selected embodiments and modifications of the invention have been disclosed and described it is apparent that still other embodiments and modifications of the invention are possible within the scope of the appended claims.

What is claimed is:

1. Improvement in apparatus for the uniform distribution of fuel to a multi-cylinder combution engine having a plurality of conduits respectively leading to the induction passages of respective ones of said cylinders of said engine, said improvement comprising a fuel metering valve assembly arranged to deliver metered quantities of fuel in accordance with the requirements of the cylinders of the engine, means defining fuel chamber means for receiving unmetered fuel without any air added thereto, a plurality of passages extending from said fuel chamber means one for each cylinder of the engine, respective ones of said passages being connected through respective ones of said conduits to the induction passage of respective ones of said cylinders of said engine, and means for admitting superatmospheric air to only an area downstream of said passage and upstream of each said conduit for conveying of the metered fuel exiting each said passage to said engine.

2. An improvement according to claim 1 wherein the magnitude of the pressure of said superatmospheric air increases as said engine approaches wide open throttle engine operating conditions.

3. An improvement according to claim 1 wherein the magnitude of the pressure of said superatmospheric air as is supplied to said area downstream of each said passage is unregulated, wherein the magnitude of the pressure of said fuel in siad fuel chamber means is superatmospheric, and further comprising pressure regulator means responsive to the magnitudes of pressures of both said superatmospheric air and said superatmospheric fuel for maintaining a substantially constant pressure differential therebetween by varying the magnitude of the pressure of said superatmospheric fuel.

4. An improvement in a fuel metering and supply system for supplying metered fuel to a plurality of cylinders of an internal combustion engine by means of a plurality of transporter conduit means for transporting a fuel-air mixture to said plurality of cylinders, the number of said transporter conduit means in said plurality of transporter conduit means being equal to the number of cylinders in said plurality of cylinders, said improvement comprising a single fuel metering valving assembly, said valving assembly comprising a single variably positionable valving member, valve seat means with respect to which said valving member is cyclically moved to closed and opened positions, a plurality of fuel metering port means, a source of fuel under superatmospheric pressure for supplying fuel to said fuel metering port means when said valving member is moved toward said opened position and thereby causing metered fuel to be discharged from said plurality of fuel metering port means, and air chamber means communicating with and situated upstream of said plurality of transporter conduit means and downstream of said fuel metering port means as to have said metered fuel flow therethrough, said air chamber means communicating with a source of air under superatmospheric pressure a to admit said superatmospheric air into said air chamber means, said superatmospheric air and said metered fuel in said air chamber means coacting with each other to form a fuel-air mixture, and wherein said fuel-air mixture flows through said plurality of transporter conduit means to said plurality of cylinders.

5. An improvement according to claim 4 and further comprising mixing chamber means, said mixing chamber means being situated immediately downstream of said air chamber means and effective to cause additional intermixing of said superatmospheric air and said metered fuel.

6. An improvement according to claim 4 wherein each of said transporter conduit means comprises an inlet situated immediately downstream of said air chamber means, wherein said inlet comprises a flow-through mixing chamber means of generally diminishing cross-sectional flow area as said mixing chamber means extends away from said air chamber means said air chamber means being effective to cause additional intermixing of said superatmospheric air and said metered fuel as such flow out of said air chamber means.

7. An improvement according to claim 4 wherein the number of said fuel metering port means in said plurality of fuel metering port means is equal to the number of said transporter conduit means.

8. An improvement according to claim 4 wherein the number of said fuel metering port means in said plurality of fuel metering port means is equal to at least twice the number of said transporter conduit means.

9. An improvement according to claim 4 wherein respective ones of said plurality of fuel metering port means are so positioned as to have said metered fuel discharged therefrom travel in a direction toward respective ones of said plurality of transporter conduit means for flow thereinto.

10. An improvement according to claim 4 wherein each of said transporter conduit means has an inlet end of relatively enlarged cross-sectional flow area, and wherein respective ones of said plurality of fuel metering port means are so positioned as to have said metered fuel discharged therefrom travel in a direction toward respective ones of said inlet ends of relatively enlarged cross-sectional flow area.

11. An improvement according to claim 4 wherein the number of said fuel metering port means in said plurality of fuel metering port means is equal to at least twice the number of said transporter conduit means, wherein each of said transporter conduit means has an inlet end of relatively enlarged cross-sectional flow area, and wherein at least pairs of said fuel metering port means are so positioned as to have said metered fuel discharged therefrom travel in directions toward a same one of said inlet ends of relatively enlarged cross-sectional flow area.

12. An improvement according to claim 4 and further comprising air distribution chamber means, said air distribution chamber means being situated generally outwardly of and about said air chamber means, said air distribution chamber means being effective to complete communication between said source of superatmospheric air and said air chamber means to thereby provide said superatmospheric air to said air chamber means.

13. An improvement according to claim 12 and further comprising a plurality of air passage means respectively interconnecting said air distribution chamber means to said air chamber means.

14. An improvement according to claim 4 wherein said air chamber means comprises air distribution chamber means generally interposed between said fuel metering port means and said transporter conduit means, and further comprising air passage means situated generally medially of said plurality of transporter conduit means and communicating between said source of superatmospheric air and said air distribution chamber means.

15. An improvement according to claim 4 wherein said air chamber means comprises air distribution chamber means, wherein said air distribution chamber means comprises a plurality of distribution chambers the number of which equals the number of said transporter conduit means, wherein respective ones of said plurality of distribution chambers are situated between said fuel metering port means and said transporter conduit means, and further comprising air passage means situated generally medially of said plurality of transporter conduit means and communicatng between said source of superatmospheric air and said plurality of distribution chambers.

16. An improvement according to claim 4 wherein said air chamber means comprises air distribution chamber means, wherein said air distribution chamber means comprises a plurality of distribution chambers the number of which equals the number of said transporter conduit means, wherein respective ones of said plurality of distribution chambers are situated between said fuel metering port means and said transporter conduit means, and further comprising air passage means situated generally medially of said plurality of transporter conduit means and communicating between said source of superatmospheric air and said plurality of distribution chambers, and mixing chamber means, said mixing chamber means being situated immediately downstream of said plurality of distribution chambers and effective to cause additional intermixing of said superatmospheric air and said metered fuel.

17. An improvement according to claim 4 wherein each of said plurality of transporter conduit means comprises a conduit section and an inlet member operatively connected to said conduit section, said inlet member having a first body portion for receiving a portion of said conduit section and a second body portion with a flow-through mixing chamber formed therein, said mixing chamber being of generally conical configuration and situated immediately downstream of said air chamber means and effective to cause additional intermixing of said superatmospheric air and said metered fuel prior to the flow thereof through said conduit section.

18. An improvement according to claim 17 and further comprising first housing means for generally holding said valving assembly, and second housing means, said second housing means being effective for holding said plurality of transporter conduit means, and wherein said air chamber means for said superatmospheric air is formed in said second housing means.

19. An improvement according to claim 4 and further comprising pressure regulator means, said pressure regulator means being responsive to the pressure magnitudes of both said air under superatmospheric pressure and said fuel under superatmospheric pressure as to maintain a substantially constant pressure differential therebetween and across said fuel metering port means.

20. An improvement according to claim 4 wherein the magnitude of the pressure of said superatmospheric air in said air chamber means increases as said engine approaches wide open throttle engine operating conditions.

21. An improvement according to claim 4 wherein the magnitude of the pressure of said superatmospheric air as is supplied to said air chamber means is unregulated, wherein the magnitude of the pressure of said fuel under superatmospheric pressure as is supplied to said fuel metering port means is unregulated, and further comprising pressure responsive means responsive to the magnitudes of pressures of both said superatmospheric air and said fuel under superatmospheric pressure for maintaining a substantially constant pressure differential therebetween and across said fuel metering port means.

22. An improvement according to claim 21 wherein said pressure responsive means comprises presure actuated valving means, wherein said pressure actuated valving means returns varying amounts of said fuel to said source of fuel in order to thereby maintain said substantially constant pressure differential.

23. An improvement according to claim 4 wherein said superatmospheric air in said air chamber means is from an ambient source of air and is unheated.

24. An improvement according to claim 17 wherein each of said inlet members is bonded to a respective one of said conduit sections.

25. An improvement according to claim 4 wherein said variably positionable valving member comprises a valving surface of generally spherical configuration.

26. An improvement according to claim 25 wherein the magnitude of the pressure of said superatmospheric air as is supplied to said air chamber means is unregulated, wherein the magnitude of the pressure of said fuel under superatmospheric pressure as is supplied to said fuel metering port means is unregulated, and further comprising pressure responsive means responsive to the unregulated magnitudes of pressures of both said superatmospheric air and said fuel air maintaining a substantially constant pressure differential therebetween and across said fuel metering port means.

27. An improvement according to claim 4 and further comprising first housing means for generally holding said valving assembly, a second housing body for holding said plurality of transporter conduit means, wherein said first housing means and said second housing body are operatively secured to each other, wherein said variably positionable valving member comprises a valving surface of generally spherical configuration, wherein said valve seat means is carried by said second housing body, and wherein said fuel metering port means are formed in said second housing body.

28. An improvement according to claim 4 wherein said variably positionable valving member comprises a tubular valving member axially piloted for movement toward and away from said valve seat means, said tubular valving member comprising a valving portion extending generally transversely of the direction of axial movement of said valving member toward and away from said valve seat means, whereby when said valving portion is seated against said valve seat means flow through said fuel metering port means is terminated.

29. An improvement according to claim 4 wherein said variably positionable valving member comprises a tubular portion axially piloted for movement toward and away from said valve seat means, a generally outwardly radiating valving portion carried by said tubular portion for movement therewith, wherein said valve seat means comprises a pilot portion and a valve seat body portion formed generally transversely of said pilot portion, wherein said plurality of fuel metering port means are formed through said valve seat body portion, wherein said pilot portion serves to axially pilot said tubular portion toward and away from said valve seat means, said radiating valving portion being effective when seated against said valve seat means to terminate flow through said fuel metering port means.

30. An improvement according to claim 4 wherein said variably positionable valving member comprises a tubular portion axially piloted for movement toward and away from said valve seat means, a generally outwardly radiating valving portion carried by said tubular portion for movement therewith, wherein said valve seat means comprises a pilot portion and a valve seat body portion formed generally transversely of said pilot portion, a fuel manifold formed in said valve seat body portion generally about said pilot portion, wherein said plurality of fuel metering port means are formed through said valve seat body portion as to be in communication with said fuel manifold, valve seat surface means formed generally about said fuel manifold, wherein said pilot portion serves to axially pilot said tubular portion and said radiating valving portion toward and away from said valve seat surface means, said radiating valving portion being effective when seated against said valve seat surface means to terminate flow of fuel into said fuel manifold and through said fuel metering port means.

31. An improvement according to claim 30 wherein said fuel manifold is formed as to be generally circularly about the axis of said pilot portion, wherein said fuel manifold is situated as to be spaced radially outwardly of said pilot portion, recess means formed generally between said tubular portion and said pilot portion, aperture means formed through said tubular portion for the flow of said fuel therethrough and into said recess means, wherein a first portion of said valve seat surface means is formed annularly generally between said recess means and fuel manifold, wherein a second portion of said valve seat surface means is formed annularly generally radially outardly of said fuel manifold, whereby when said tubular portion and said radiating valve portion are moved away from said valve seat surface means fuel flows into said fuel manifold from two directions the first of which is radially outwardly from said recess means and the second of which is radially inwardly past said second portion of said valve seat surface means.

32. The improvement according to claim 28 wherein said transversely extending valving portion is flexible so as to effect a greater dimensional tolerance accommodation in sealing with said valve seat means as compared to a non-flexible transversely extending valving portion.

33. An improvement according to claim 4 wherein said variably positionable valving member comprises a valving surface of generally spherical configuration, and further comprising air distribution chamber means, said air distribution chamber means situated generally outwardly of and about said air chamber means, said air distribution chamber means being effective to complete communication between said source of superatmospheric air and said air chamber means to thereby provide said superatmospheric air to said air chamber means.

34. An improvement according to claim 33 and further comprising a plurality of air passage means respectively interconnecting said air distribution chamber means to said air chamber means.

35. An improvement according to claim 33 and further comprising first housing means for generally holding said valving assembly, a second housing body for holding said plurality of transporter conduit means, wherein said first housing means and said second housing body are operatively secured to each other, wherein said valve seat means is carried by said second housing body, wherein said fuel metering port means are formed in said second housing body, and further comprising a plurality of air passage means respectively interconnecting said air distribution chamber means to said air chamber means, and wherein said plurality of air passage means are formed in said second housing body.

36. An improvement according to claim 4 wherein said variably positionable valving member comprises a valving surface of generally spherical configuration, and further comprising air suppy passage means, said air supply passage means being situated generally inwardly of and among said air chamber means, said air supply passage means being effective to complete communication between said source of superatmospheric air and said air chamber means to thereby provide said superatmospheric air to said air chamber means.

37. An improvement according to claim 36 and further comprising first housing means for generally holding said valving assembly, a second housing body for holding said plurality of transporter conduit means, wherein said first housing means and said second housing body are operatively secured to each other, wherein said valve seat means is carried by said second housing body, wherein said fuel metering port means are formed in said second housing body, and wherein said air supply passage means is formed in said second housing body.

* * * * *

UNITED STATES PATENT AND TRADEMARK OFFICE

CERTIFICATE OF CORRECTION

PATENT NO. : 4,708,117

DATED : November 24, 1987

INVENTOR(S) : Mesenich et al

It is certified that error appears in the above-identified patent and that said Letters Patent is hereby corrected as shown below:

On the title page Item (75) inventor, "Daniel E. Alsbrooks" should read -- Daniel E. Alsobrooks --.

Signed and Sealed this

Second Day of August, 1988

*Attest:*

*Attesting Officer*

DONALD J. QUIGG

*Commissioner of Patents and Trademarks*